US006663102B2

(12) United States Patent
Takahashi et al.

(10) Patent No.: US 6,663,102 B2
(45) Date of Patent: Dec. 16, 2003

(54) SHEET DISCHARGE CONTROL METHOD AND SHEET DISCHARGE APPARATUS

(75) Inventors: Masaya Takahashi, Yamanashi-ken (JP); Shinya Sasamoto, Nirasaki (JP)

(73) Assignee: Nisca Corporation, Yamanashi-ken (JP)

( * ) Notice: Subject to any disclaimer, the term of this patent is extended or adjusted under 35 U.S.C. 154(b) by 0 days.

(21) Appl. No.: 10/160,275

(22) Filed: Jun. 4, 2002

(65) Prior Publication Data

US 2002/0180143 A1 Dec. 5, 2002

(30) Foreign Application Priority Data

Jun. 4, 2001 (JP) ..... 2001-168817

(51) Int. Cl.[7] ..... B65H 31/10

(52) U.S. Cl. ..... 271/217; 271/213; 271/214; 271/215; 271/220

(58) Field of Search ..... 271/213, 214, 271/215, 217, 220

(56) References Cited

U.S. PATENT DOCUMENTS 4,605,211 A * 8/1986 Sonobe ..... 270/58.17
6,390,466 B1 * 5/2002 Sanmiya ..... 271/213
2001/0050459 A1 * 12/2001 Tamura et al. ..... 271/217

FOREIGN PATENT DOCUMENTS

JP 03095065 A * 4/1991 ..... B65H/31/14

* cited by examiner

*Primary Examiner*—Donald P. Walsh
*Assistant Examiner*—Kaitlin Joerger
(74) *Attorney, Agent, or Firm*—Kanesaka & Takeuchi

(57) ABSTRACT

A configuration controls the height and the inclination of a stacking tray according to the number of sheets discharged and controls the height and the inclination of a stacking tray when discharging sheets and when discharging sheet bundles to improve alignment of discharged sheets and the transporting characteristics. When discharging a sheet bundle, a stacking tray is lowered and when it reaches its home position, the aforementioned stacking tray is stopped. When discharging a sheet, the system determines whether it is the first sheet of a plurality of sheets in a bundle. For the first sheet, a timer is set to a predetermined time from raising to stopping the aforementioned stacking tray (using a pulse count value) and the aforementioned stacking tray is raised. After the set time is up, the stacking tray is stopped at a preset position.

20 Claims, 22 Drawing Sheets

| | Sheet stacking amount detection sensor 85a | Sheet stacking amount detection sensor 85b |
|---|---|---|
| Sheet surface empty (4) | OFF | OFF |
| Lever is stored (1) | OFF | ON |
| Sheet surface OFF (3) | ON | OFF |
| Sheet surface ON (2) | ON | ON |

SHEET DISCHARGE CONTROL METHOD AND SHEET DISCHARGE APPARATUS

BACKGROUND OF THE INVENTION AND RELATED ART STATEMENT

This invention relates to a sheet discharge control method and a sheet discharge apparatus for stacking sheets formed thereupon with images discharged from an image forming apparatus such as a copier or printer.

Conventionally, a sheet discharge apparatus (or a so-called finisher) is used for stacking sheets formed thereupon with images by an image forming apparatus such as a copier or printer on a stacking tray. These types of sheet discharge apparatuses have a straight operating mode and a shift operating mode that performs later processes such as stapling the sheets or punching holes therein, according to the operating instructions on the image forming apparatus.

In the straight operating mode, sheets are discharged directly to the stacking tray passing through the transport path while in the shift operating mode, a plurality of sheets sequentially switched back to a processing tray along a transport path undergo subsequent processing such as stapling or hole punching after having been aligned by an aligning means, then are discharged to a stacking tray as a sheet bundle.

FIG. 22 illustrates the state of discharge of sheets formed with images in the conventional sheet discharge apparatus, FIG. 23 is a flowchart showing the processing procedures relating to the positioning control of a stacking tray on a conventional sheet discharge apparatus.

In FIG. 22 and FIG. 23, the sheet S is sent to the sheet discharge apparatus 11 from the image forming apparatus G such as a copier or printer. At the same time, a command specifying the binding mode is received from the image forming apparatus to the sheet discharge apparatus 11 thereby setting this mode. A paper surface detection lever, not shown in the drawings, protrudes to hold the sheet S with this operation setting. The position of the stacking tray 15 is determined after a set time has passed and is positioned (step S1). Also, if not already positioned at the predetermined home position, the stacking tray 15 is controlled to be elevated to the home position.

Firstly, if the stacking tray 15 is at its lowest position, a control is executed to raise it. When it is recognized at its home position, the raising of the stacking tray 15 is stopped (steps S2, S3 and S4.) If the stacking tray 15 is at its home position at step S1, the stacking tray 15 is not moved (step S5). Then, if the stacking tray 15 is at its highest position, a control is executed to lower it (step S6). When it is recognized to be at its home position, the lowering of the stacking tray 15 is stopped (steps S7 and S8.)

Thus sheets are discharged to the stacking tray 15 at the home position. In other words, sheets are discharged to their normal position in the stacking tray 15 at the home position. In such cases, if the stacking tray 15 is positioned lower than the home position, sheets will fall into the stacking tray 15, as shown in FIG. 22.

With this shift mode, a sheet is transported while a processing weight, not shown in the drawings, rotatably supported above the endless transport belt 28 presses against to touch the endless transport belt 28 to the sheet S, but the sheet S experiences curls (the edges of the sheet curl upward) caused by the image forming process in the image forming portion of the image forming apparatus G. Because the upstream edge of the sheet S curls upward, after the upstream edge of the sheet in the direction of transport passes the nipping region pressed to the endless transport belt by the aforementioned processing weight, there is less contact surfaces therebetween the sheet and caterpillar roller thus making it difficult to transmit the endless transport belt 28's transport force to the sheet S, thus causing the problem of not fully switching back the sheet S in the processing tray 39.

Furthermore, as shown in FIG. 22, if the gap between the stacking tray 15 and processing tray 39 is large in the vertical direction, the sheet S will slip down into the stacking tray 15, the upstream edge of the sheet S in the transport direction being urged in a direction away from the endless transport belt 28. This makes it even more difficult to transmit the transport force from the endless transport belt 28 to the sheet S. Even if the sheet S were to be in contact with the sheet S, a bending would develop in the sheet S between the stacking tray 15 and the caterpillar roller thereby increasing the transport load and making it difficult for the sheet to be completely switch-back transported by the endless transport belt 28.

Note that when the second or subsequent sheet is transported, it passes over the first sheet and the transport is executed without error and such bending stops occurring.

To resolve the issues of the prior art, an object of the present invention is to provide a program for a sheet discharge control method and a sheet discharge control apparatus that can control the relative heights and angles of a stacking tray and to process according to the number of sheets discharged and to control the height and angle of the stacking tray when discharging sheets and when discharging sheet bundles to improve the alignment of discharged sheets and the characteristics of transport thereof.

SUMMARY OF THE INVENTION

To attain the aforementioned objectives, the sheet discharge apparatus according to the present invention is equipped with a discharge means for discharging sheets received from an image forming apparatus, a support means established downstream of the aforementioned discharge means in the direction of sheet discharge, a storage means established downstream of the aforementioned support means in the direction of sheet discharge, a transport means for transporting to the aforementioned storage means a sheet discharged by the aforementioned discharge means straddling the aforementioned support means and the aforementioned storage means, an elevator means for relatively raising or lowering the aforementioned support means and the aforementioned storage means and a control mean to control the aforementioned elevator means to vary the position of the aforementioned storage means to the aforementioned support means according to the number of sheets discharged by the aforementioned discharge means.

The sheet discharge apparatus according to the present invention has a control means for controlling the aforementioned elevator means so that the relative position of the aforementioned storage means is lower with regard to the aforementioned support means after a determined number of sheets are discharged by the aforementioned discharge means.

The sheet discharge apparatus according to the present invention has a control means for controlling the aforementioned elevator means so that the downstream edge in the direction of transport of a sheet discharged by the aforementioned discharge means is higher than the highest level of the aforementioned support means until a determined number of sheets are discharged by the aforementioned discharge means.

To attain the aforementioned objectives, the sheet discharge apparatus according to the present invention is equipped with a discharge means for discharging sheets received from an image forming apparatus, a support means established downstream of the aforementioned discharge means in the direction of sheet discharge, a storage means established downstream of the aforementioned support means in the, direction of sheet discharge, a transport means for transporting to the aforementioned storage means a sheet discharged by the aforementioned discharge means straddling the aforementioned support means and the aforementioned storage means, an inclining means for varying the relative angle of incline of the aforementioned support means and the aforementioned storage means and a control means to control the aforementioned inclining means so that the angle of incline of the aforementioned storage means to the aforementioned support means is different.

The sheet discharge apparatus according to the present invention has a control means for controlling the aforementioned inclining means so that the angle of incline of the aforementioned storage means is smaller with regard to the aforementioned support means after a determined number of sheets are discharged by the aforementioned discharge means.

The sheet discharge apparatus according to the present invention has a control means for controlling the aforementioned inclining means so that the downstream edge in the direction of transport of a sheet discharged by the aforementioned discharge means is higher than the highest level of the aforementioned support means until a determined number of sheets are discharged by the aforementioned discharge means.

To attain the aforementioned objectives, the sheet discharge apparatus according to the present invention is equipped with a discharge means for discharging sheets received from an image forming apparatus, a support means established downstream of the aforementioned discharge means in the direction of sheet discharge, a storage means established downstream of the aforementioned support means in the direction of sheet discharge, a transport means for transporting to the aforementioned storage means a discharged sheet by the aforementioned discharge means straddling the aforementioned support means and the aforementioned storage means, an elevator means for relatively raising or lowering the aforementioned support means and the aforementioned storage means, an inclining means for varying the relative angle of incline of the aforementioned support means and the aforementioned storage means and a control means for controlling the aforementioned elevator means so that the position of the aforementioned storage means to the aforementioned support means varies when discharging the sheet with the aforementioned discharge means and when transporting the sheet with the aforementioned transport means.

The sheet discharge apparatus according to the present invention has a control means for controlling the aforementioned elevator means so that the relative position of the aforementioned storage means is lower with regard to the aforementioned support means after a determined number of sheets are discharged by the aforementioned discharge means.

The sheet discharge apparatus according to the present invention has a control means for controlling the aforementioned elevator means so that the downstream edge in the direction of transport of a sheet discharged by the aforementioned discharge means is higher than the highest portion of the aforementioned support means when sheets are discharged by the aforementioned discharge means.

The sheet discharge apparatus according to the present invention is equipped with a discharge means for discharging sheets received from an image forming apparatus, a support means established downstream of the aforementioned discharge means in the direction of sheet discharge, a storage means established downstream of the aforementioned support means in the direction of sheet discharge, a transport means for transporting to the aforementioned storage means a discharged sheet by the aforementioned discharge means straddling the aforementioned support means and the aforementioned storage means, an elevator means for relatively raising or lowering the aforementioned support means and the aforementioned storage means, and a control means for controlling the aforementioned inclining means so that the angle of incline of the aforementioned storage means to the aforementioned support means is different when discharging the sheet with the aforementioned discharge means and when transporting the sheet with the aforementioned transport means.

The sheet discharge apparatus according to the present invention has a control means for controlling the aforementioned inclining means so that the angle of incline of the aforementioned storage means is smaller with regard to the aforementioned support means for the sheet transfer by the aforementioned transfer means that the discharge of sheets by the aforementioned discharge means.

The sheet discharge apparatus according to the present invention has a control means for controlling the aforementioned inclining means so that the downstream edge in the direction of transport of a sheet discharged by the aforementioned discharge means is higher than the highest portion of the aforementioned support means when sheets are discharged by the aforementioned discharge means.

The sheet discharge apparatus according to the present invention is further equipped with a finishing means that finishes sheets discharged by the aforementioned discharge means, while straddling the aforementioned support means and the aforementioned storage means This structure controls the height and the incline of the stacking tray according to the number of sheets discharged and controls the height and the inclining of the stacking tray according to sheet discharge and to sheet bundle discharge. Therefore, it improves the alignment of discharged sheets and transporting characteristics.

DETAILED DESCRIPTION OF THE PREFERRED EMBODIMENT

Figure 22:
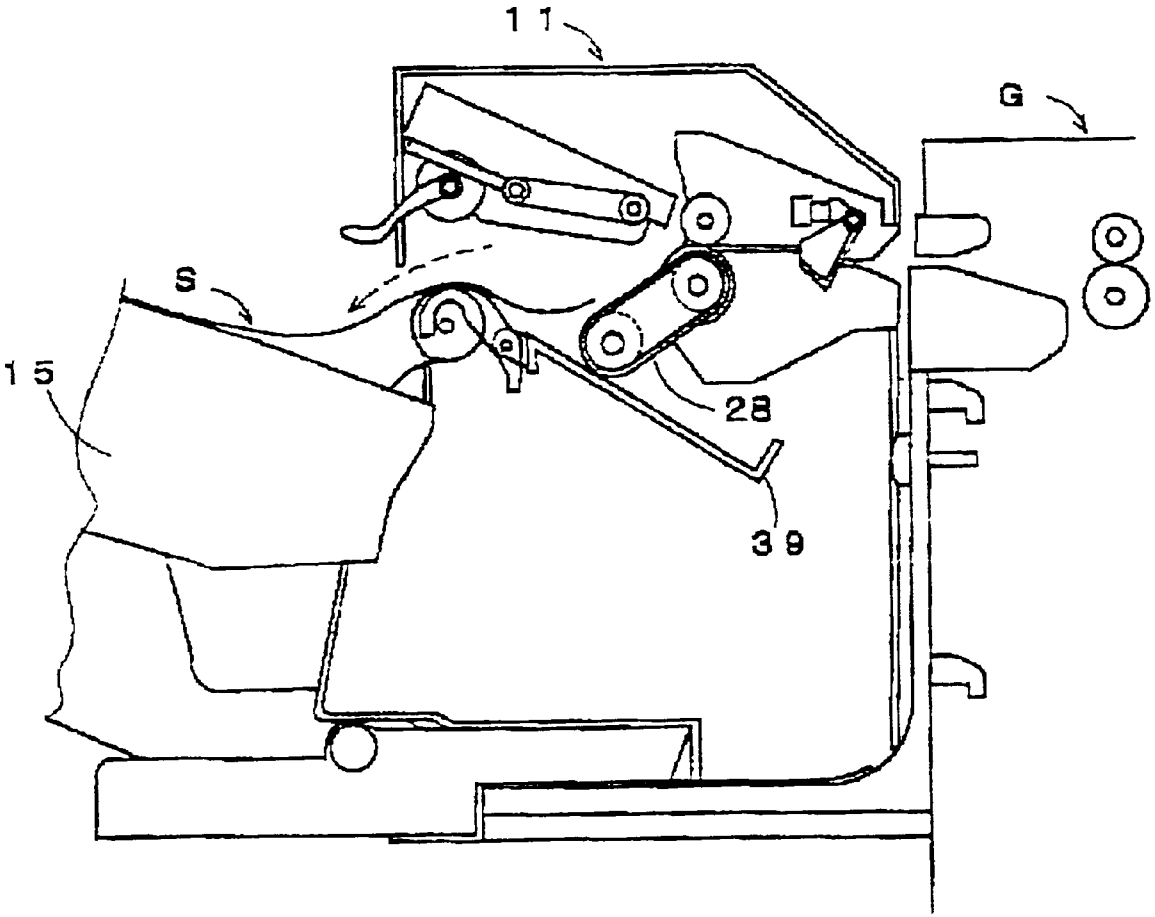
FIG. 22 PRIOR ART
FIG. 22 illustrates the discharge of sheets formed with images in sheet discharge apparatus according to the prior art.
Figure 23:
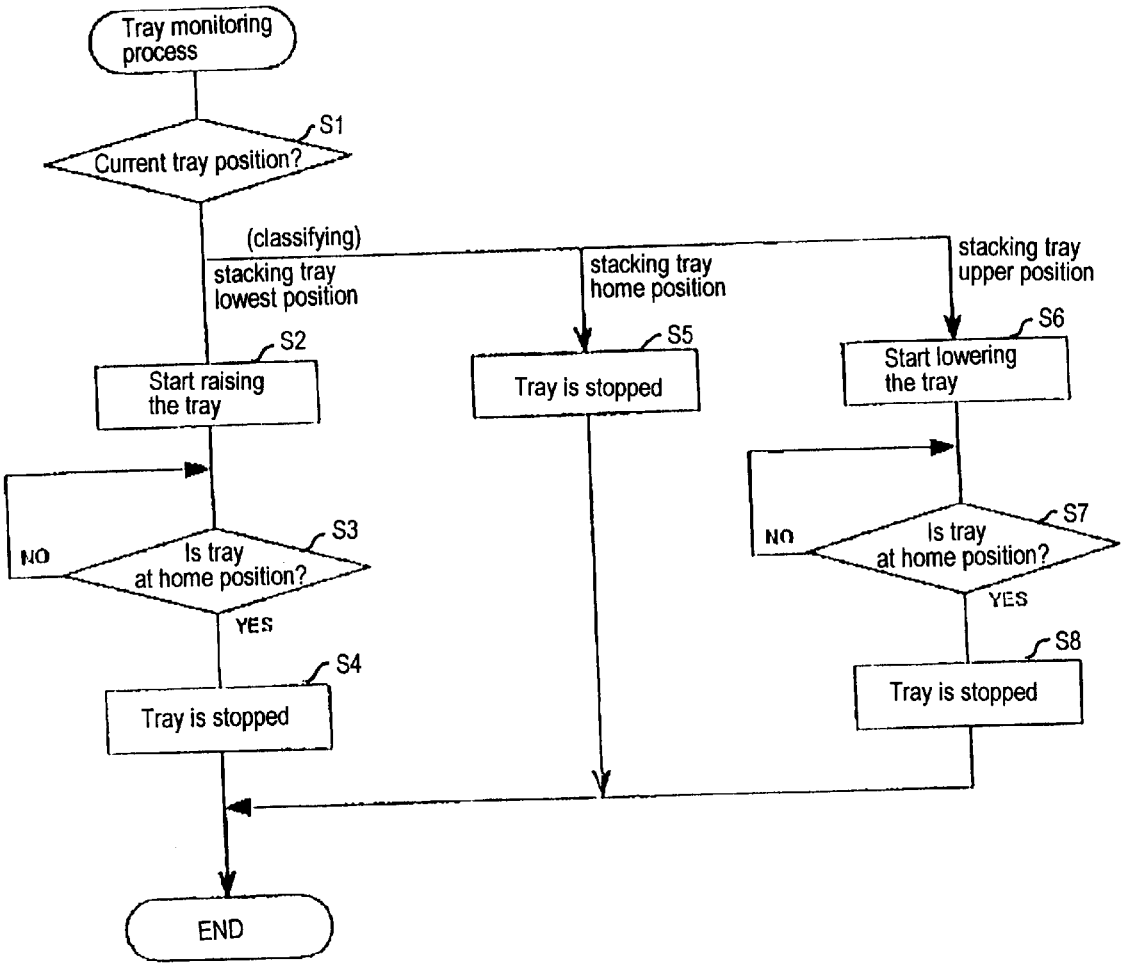
FIG. 23 PRIOR ART
FIG. 23 is a flowchart representing the procedures for processing of the stacking tray position control according to the prior art.

The following shall describe in detail the embodiment of a program together with the sheet discharge control method and sheet discharge apparatus according to the present invention in reference to the drawings provided. The same numbers are used for the same structural elements as were used in the prior art shown in FIG. 22.

Figure 1:
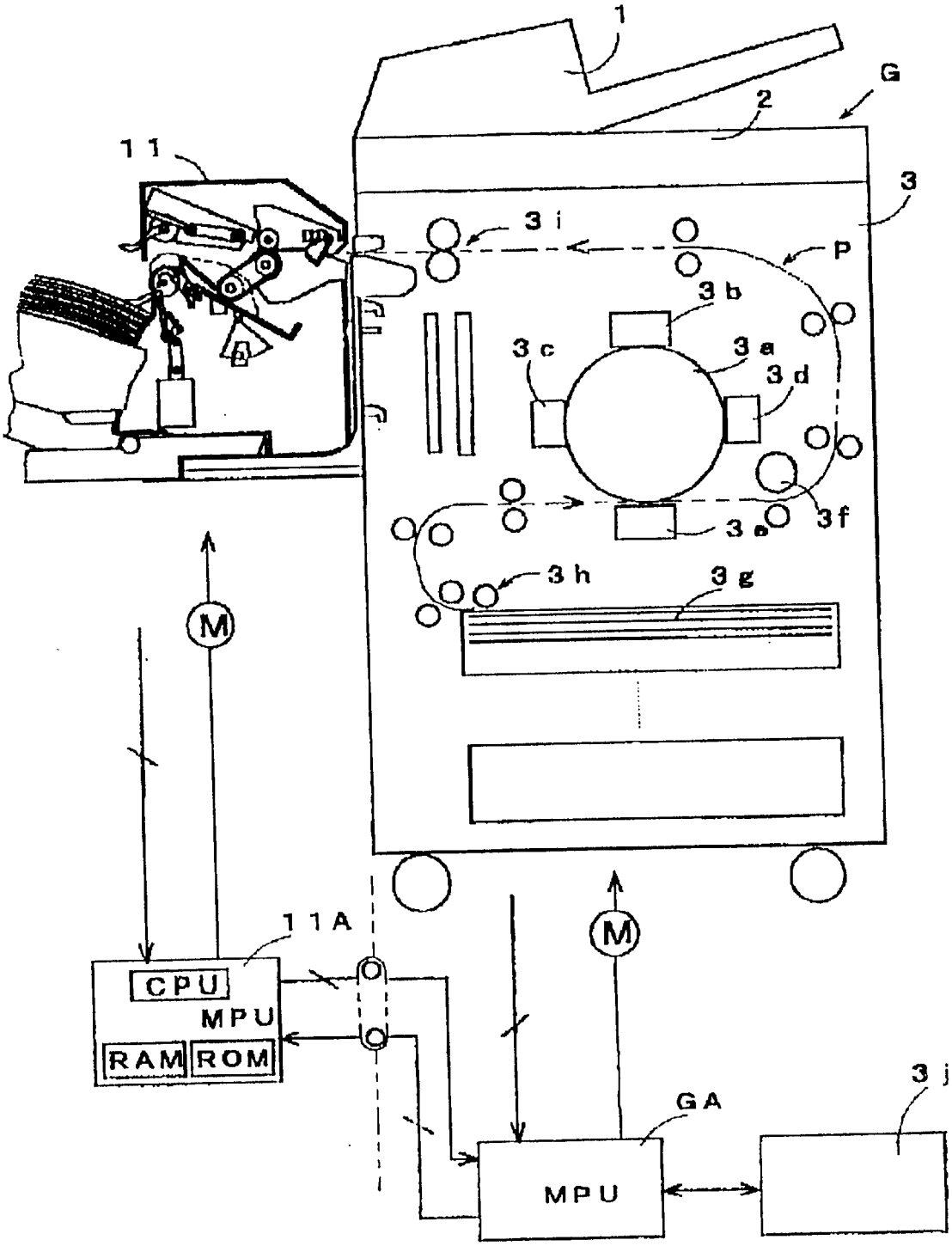
FIG. 1 is a model drawing indicating the entire configuration of the embodiment of the present invention.

FIG. 1 is a model drawing indicating the entire configuration of the embodiment of the present invention. In FIG. 1, G is the image forming apparatus such as a copier or a printer. 11 is a finisher apparatus as an example of the sheet discharge apparatus detachably configured to the image forming apparatus G.

The image forming apparatus G shown in FIG. 1 indicates the essential structures of well known copiers or printers and is equipped with a scanner 2 below an automatic document feeder (or ADF) 1. The image generation portion (printer engine) 3 is arranged below the scanner 2.

The electrostatic body 3*b*, the developer 3C, the cleaner 3*d* and the transfer device 3*e* are arranged on the circumference of the photoconductor body 3*a* in the image generation portion 3. Also, a plurality of rollers (from the pick-up roller 3*h* to the discharge roller 3*i*) are established along the transport path P to correspond to the control for a series of printing processes from discharging at the photoconductor 3*a* to removal of toner, for the size of the sheet S (paper). A paper cassette (3*g*) that stores sheets of the same size is arranged therebelow.

Figure 2:
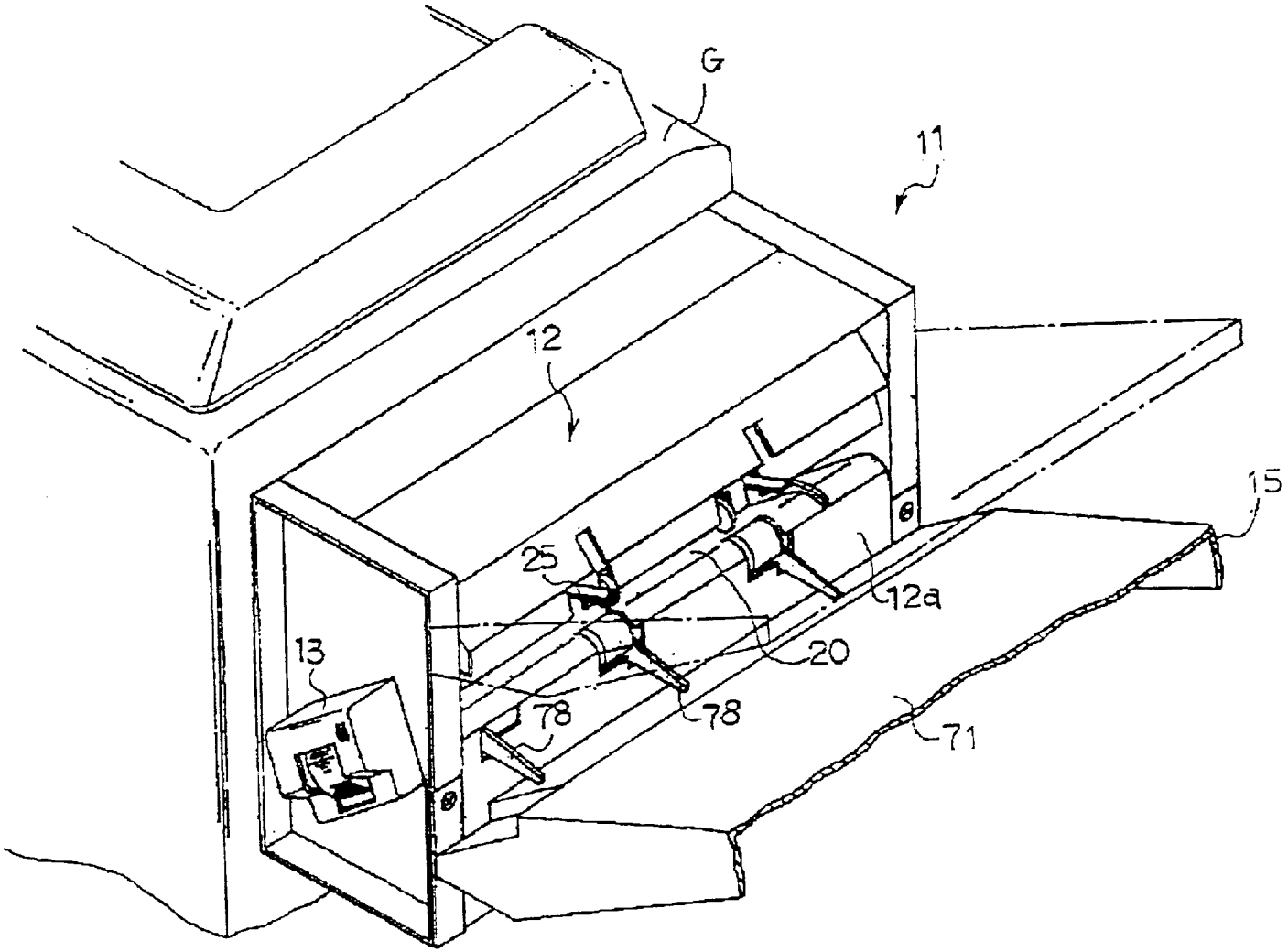
FIG. 2 is a perspective view of the essential external configuration of the finisher apparatus shown in FIG. 1.
Figure 3:
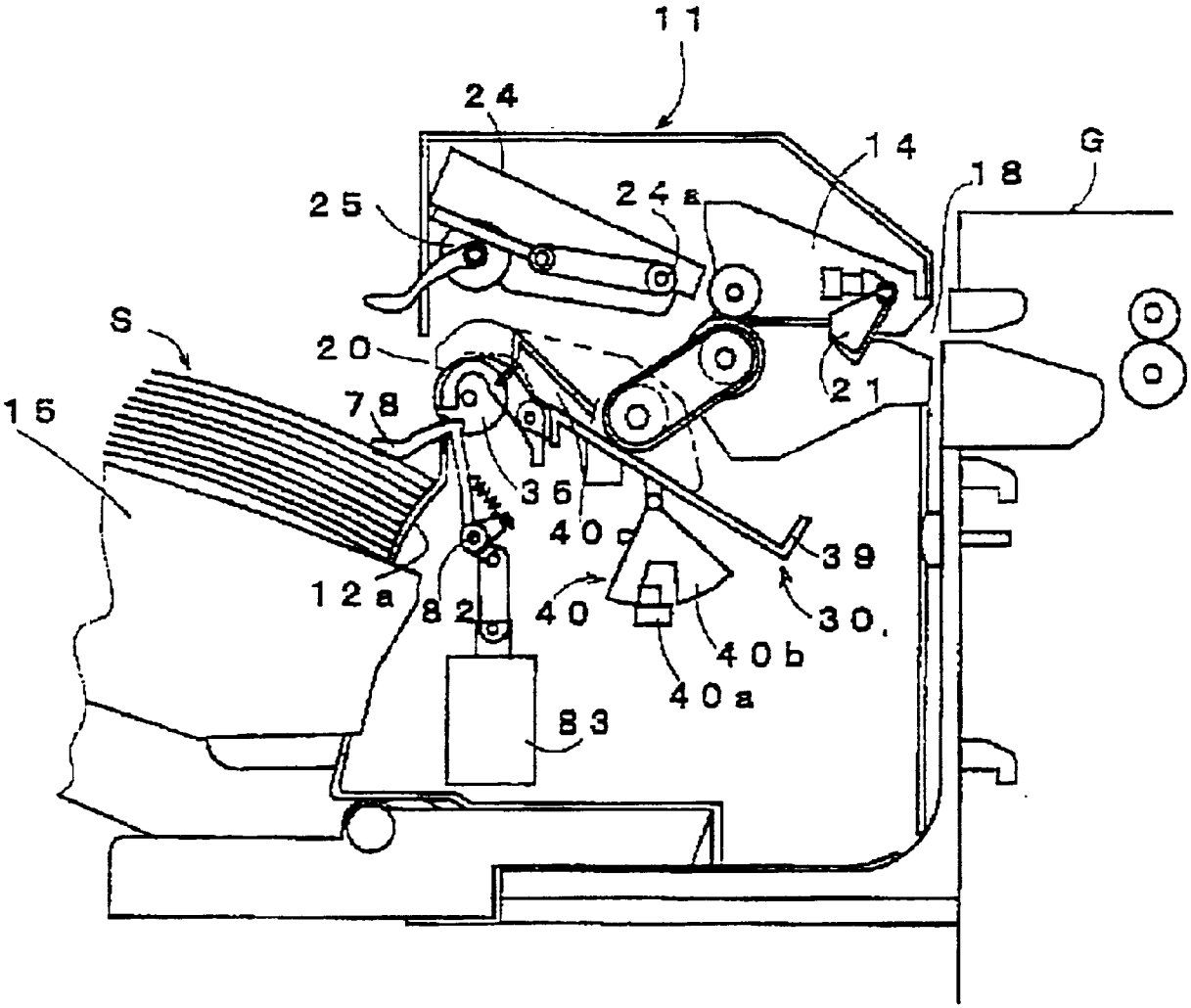
FIG. 3 is a side view of the essential external configuration of the finisher apparatus shown in FIG. 1.

The following describes the configuration of the finisher apparatus 11 in detail according to FIG. 2 and FIG. 3.

In image forming apparatus such as the type illustrated with the image forming apparatus G and finisher apparatuses 11, a microprocessor (MPU) GA controls well known and various printing processes in the series thereof from discharging to removal of toner and the control of the motor's drive, and executes a variety of display and input processes on the touch panel 3*j* relating to printing.

Also, the finisher 11 controls a variety of processes according to each of the straight operation and the shift operation modes, described in detail below, on sheets discharged from the image forming apparatus G and motor drive control according to the microprocessor (MPU) 11.

Also, the microprocessor GA and 11A are interlocked to execute according to the present invention described in detail below. This interlock outputs the status signal from the image forming apparatus G to the finisher apparatus 11 and controls by control command outputs from the finisher apparatus 11 to the image forming apparatus G.

The following shall describe the finisher apparatus 11 in detail. FIG. 2 is a side view of the external configuration of the essential portions of the finisher apparatus 11 and FIG. 3 is a side elevation view of the internal configuration of the essential portions of the finisher apparatus 11.

As clearly illustrated in FIG. 1 to FIG. 3, the finisher apparatus 11 is disposed with a main apparatus 12, a staple unit 13 mounted to one side frame of this main apparatus 12 and a drive transmission mechanism, not shown in the drawings, arranged on the other side of the main apparatus 12. Furthermore, it is equipped with an inlet 18 to which sheets formed thereupon with images discharged from the image forming apparatus G are supplied, the discharge outlet 20 formed on a side opposite to the inlet 18 and the storage means or stacking tray 15 for stacking the sheet S discharged from the discharge outlet 20.

Note that the staple unit 13 can be a stapler for binding a bundle of the sheets S using staples, or it can be arranged with a punching unit for punching holes thereto.

The main apparatus 12 comprises the first transport path that guides the sheet S from the inlet 18 into the main apparatus 12 and the second transport path for the discharge of the sheet S to the stacking tray 15 through the discharge outlet 20 and the third transport path having a difference in level with the second transport path and guides the sheet S to inside of the processing tray 39 for temporary storage after switching back the direction of transport thereof. At the processing tray 39, a pressing drive member (not shown in the drawings) presses the adjacent edges of each of the sheet S so that they are aligned, then the aforementioned staple unit 13 stables the sheet bundle or punches holes therein with a punching unit, which is not shown in the drawings.

The following shall describe only stapling of the sheet bundles. Note that the finisher apparatus 11 comprises the following operation mode to transport the sheet S, that is distinguished from the first to the third transport paths.

(1) Straight Operation Mode:

The sheet S is discharged directly to the stacking tray 15 from the first transport path through the second transport path.

(2) Shift Operation Mode (Performing the Stapling Operation):

The sheet S transported from the first transport path to the second transport path is transported for switch-back from the second transport path along the third transport path and while a plurality of the sheet S is stacked and placed on the processing tray 39, the edges thereof are aligned. Then, the staple unit 13 binds the sheet S bundle having been aligned, at a determined position after aligning, the sheet S bundle is discharged to the stacking tray 15.

The first transport path comprises the inlet sensor 21 and the endless transport belt 28 that transports the sheet S to the second transport path. Below the endless transport belt 28 is disposed support means or processing tray unit 30. The processing tray unit 30 temporarily stacks and places the sheet S so that the sheet S bundle of a predetermined number of sheets sequentially drawn in by the rotation of the endless transport belt 28 can be bound by staples by the staple unit 13.

Above the second transport path is disposed the pivoting unit 24 that pivots upward and downward on the shaft pivot of the paddle drive roller shaft 24*a*.

In the pivoting unit 24 the follower discharge roller (bundle discharge roller) 25 is disposed. The pivoting unit 24 pivots downward to a position where it can grip the sheet S or the sheet S bundle between the follower discharge roller 25 and the discharge roller 36 to discharge the sheet S or the sheet S bundle to the stacking tray 15 from the discharge outlet 20 when discharging the sheet S directly to the stacking tray 15 from the first transport path through the second transport path in the straight operation mode and when discharging the sheet S bundle to the stacking tray 15 in the processing tray unit 30 when in the shift operation mode. Conversely, when leading the sheet S to the third transport path to the processing tray unit 30, the pivoting unit 24 pivots upward, as shown in FIG. 3, so that it does not interfere with the sheet S being switch-back transported.

Below the discharge roller 36 the sheet abutting member 12*a* that regulates the edges of the sheet S stacked in the stacking tray 15 is configured to be unitized with the front surface frame of the main apparatus 12. To a position near the discharge roller 36 on the sheet abutting member 12*a* is established the sheet holder lever 78 that appears and disappears toward the second transport path from the upper position on the sheet abutting member 12*a*, passing through the aperture established.

The sheet holder lever 78 is driven to appear and disappear from within the sheet abutting member 12*a* toward the stacking tray 15 by the holding lever solenoid 83 positioned on the back side of the sheet abutting member 12*a* each time the sheet S or the sheet S bundle is discharged by the discharge roller 36 and the follower discharge roller 25.

Figure 4:
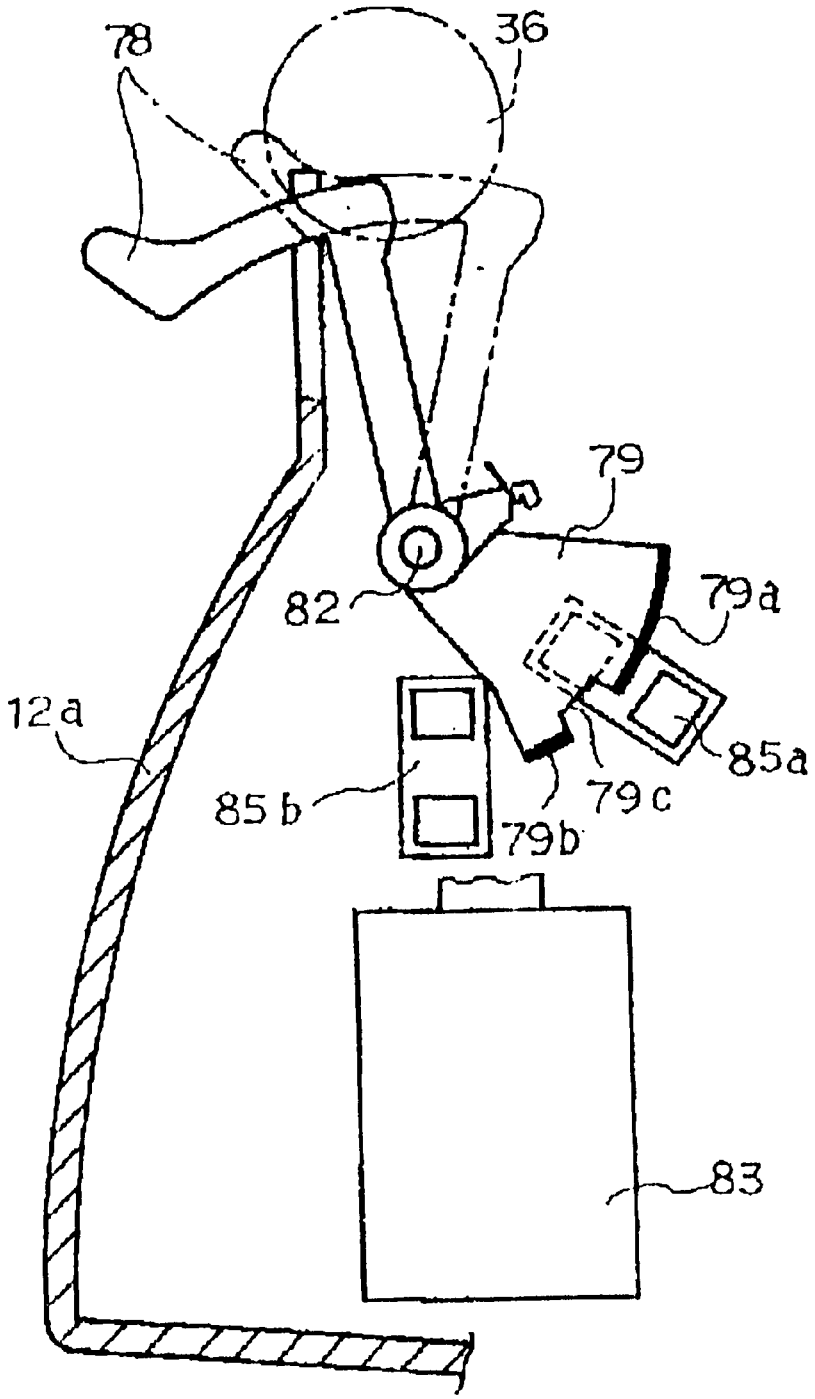
FIG. 4 illustrates the mechanism for detecting the stacking tray position.

As shown in FIG. 4, the sheet holder lever 78 rotates with the rotating shaft 82 as the shaft pivot, but when the sheet holder lever 78 is pressing the sheet S, the first flag 79*a* on the detection flag 79 and the second flag 79*b* established on the edge of this lever are detected by the sheet stacking amount detection sensors 85*a* and 85*b* to detect the uppermost sheet surface position stacked on the stacking tray 15. Based on this signal, the elevator drive motor M (not shown in the drawings) for the stacking tray 15 is accurately controlled to rotate in forward or reverse, thereby maintaining a constant level for the uppermost sheet surface stacked on the stacking tray 15.

Note that the between the first flag 79*a* and the second flag 79*b* on the detection flag 79 is established the notch portion 79*c* which does not act upon the sheet stacking amount detection sensors 85*a* and 85*b*.

A sensor 40 is established below the processing tray 39. This sensor 40 is composed of the sensor lever 40*c* extending into the second transport path on the discharge outlet 20 side, the sensor flag 40*b* rotatingly supported by the sensor rotation shaft below the processing tray 39 and the sheet presence sensor 40*a* that detects the sensor flag 40*b*.

This sensor lever 40*c* extends into the second transport path when no sheet S is present therein. This sensor 40 detects the presence of the sheet S in the second transport path and the presence of the sheet S at the sheet stacking portion on the processing tray 39.

In other words, the sensor 40 functions as a transport pass-through sensor for the trailing edge of the sheet discharged, when stacking a sheet on the stacking tray 15 when passing from the first transport path to the second transport path without being stacked in the sheet stacking portion. Also, the sensor 40 detects the passing through for discharge of the sheet S bundle when discharging them as a bundle from the processing tray 39.

Also, the passing detection signal produced by the sensor 40 is used as the activating signal for the holding lever solenoid 83 to actuate the sheet holder lever 78.

Figure 5:
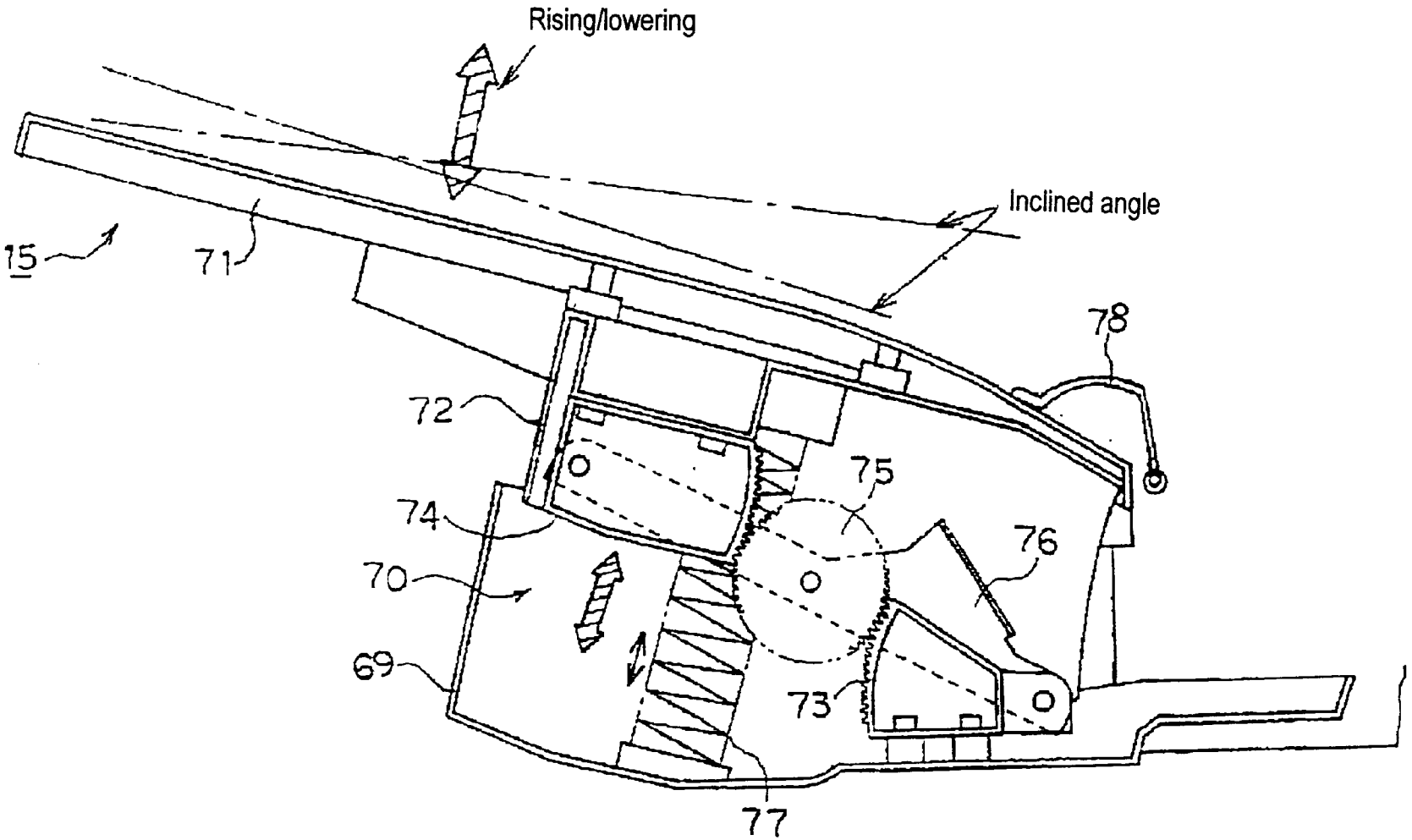
FIG. 5 is a side view of the configuration of the stacking tray of FIG. 1.

Next, we shall describe the stacking tray 15. FIG. 5 is a side view of the configuration of the stacking tray 15.

The stacking tray 15 in FIG. 5 is mounted to the base 69 comprising a detachable mounting portion on the main apparatus 12 shown in FIG. 1 and in FIG. 2, and the sheet storage portion 71 elevatingly held to the base 69 via the elevator control portion 70. The support bracket 72 fastened to the undersurface of the sheet storage portion 71 is mounted to the upper surface of the movable gear 74.

The elevator control portion 70 is equipped with the arc-shaped fixed gear 73 mounted to the base 69, the arc-shaped movable gear 74 mounted to the support bracket 72, the planetary gear 75 that meshes and displaces the gears 73 and 74, the shift arm 76 mounted at a relative distance and interlocked with the planetary gear 75 and the coil spring 77 that constantly urges the sheet storage portion 71 upward, established between the upper surface of the base 69 and the support shaft 72.

This coil spring 77 displaces the sheet storage portion 71 downward in correspondence to the weight of the sheet S stacked sequentially on the upper surface of the sheet storage portion 71, the elasticity constant being set so that the top surface of the sheet S sequentially stacked remains substantially a constant height as the previous sheet that was stacked thereupon. Also, as the sheet storage portion 71, which is the support surface for the sheet S, displaces downward in resistance to the elasticity of the coil spring, lowers as the volume of the sheet S stacked upon the upper surface thereof from the upward direction in the figure, mounted via the support bracket 72 on the uppers surface of the movable gear 74 in accordance to the displacement of the meshing positions of the gears 73 and 74 and the planetary gear 75 to move substantially parallel to the lower limit position on the arrow.

To the planetary gear 75, the motor M (not shown in the drawings) is established to execute the height adjustment control for the stacking tray 15 when the sheet S is removed, explained below, by the microprocessor 11A. Furthermore, the sheet storage portion 71 and the support bracket 72 are configured as separate bodies. For example, while the sheet storage portion 71 is rotatingly supported with the support bracket 72 as the pivot point, a drive mechanism for rotating the sheet storage portion 71 is disposed between the sheet storage portion 71 and the support bracket 72. Control of this drive mechanism by the microprocessor 11A changes the angle of inclination of the sheet storage portion 71 (stacking tray 15) to enable attaining the same effect.

The following shall describe the embodiment according to the present invention. First, we shall explain the relationship of the position of the sheet holder lever 78 and the detection signals.

Figure 6:
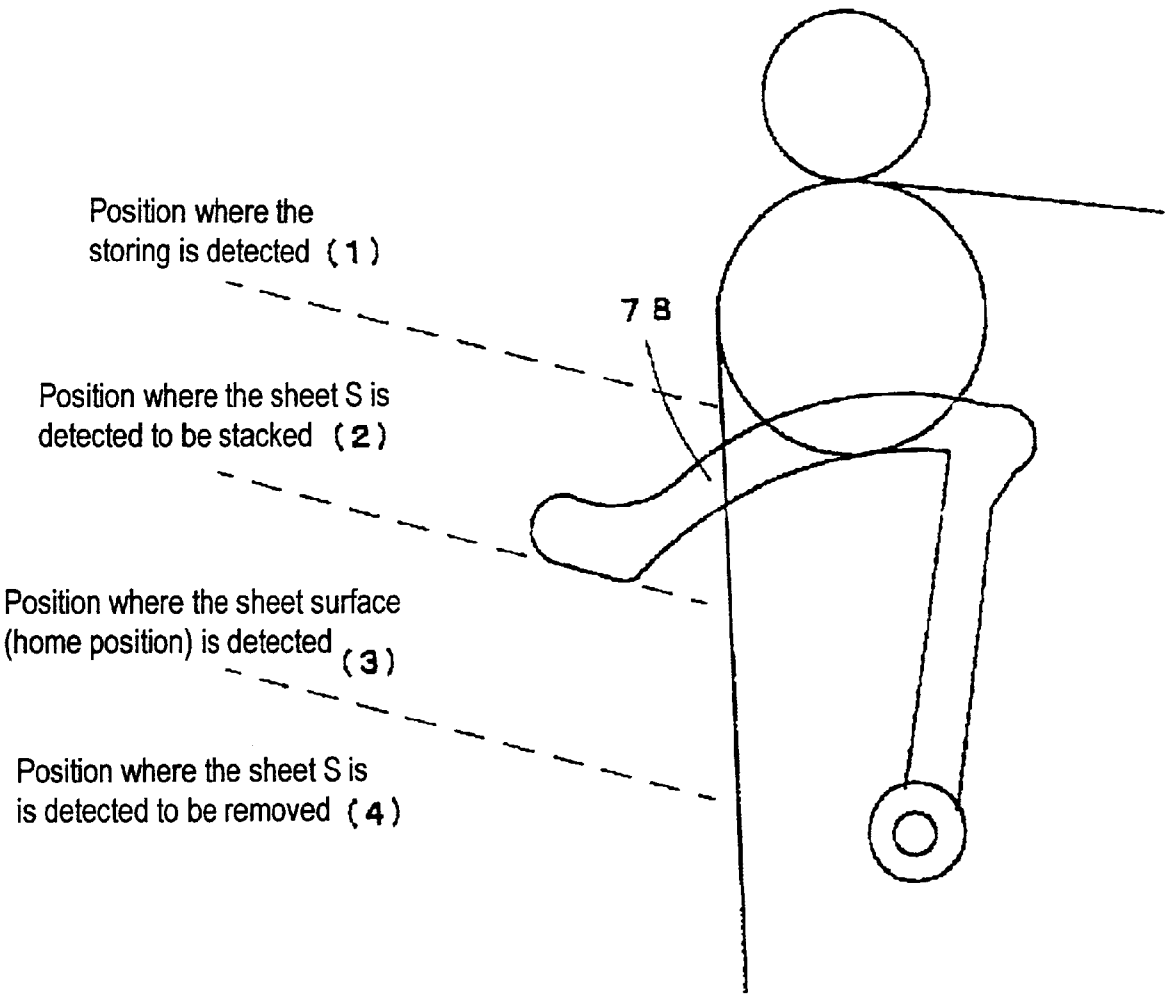
FIG. 6 illustrates the sheet holder lever position of an embodiment of the invention.
Figures 7, 8:
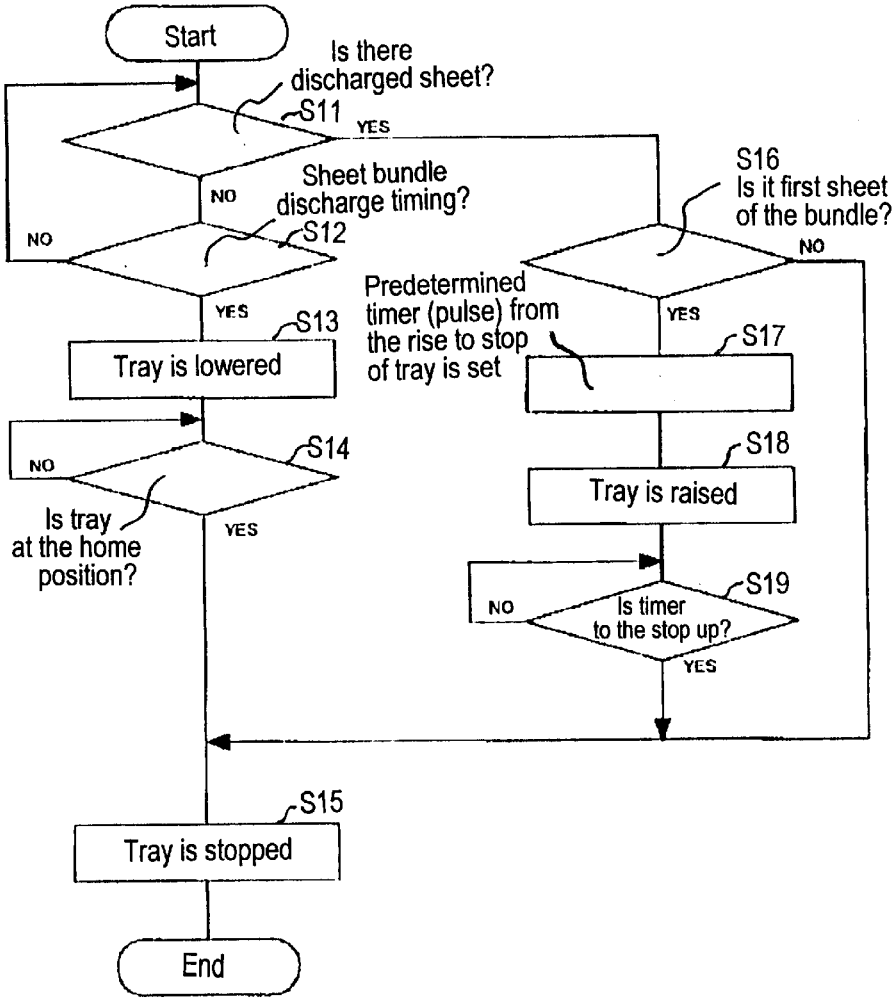
FIG. 7 illustrates the detection signals for the sheet holder lever position of an embodiment of the invention.
FIG. 8 is a flowchart representing the general procedures for processing of the first embodiment.

FIG. 6 illustrates the position of the sheet holder lever 78, FIG. 7 illustrates the detection signal in the sheet holder lever 78 position, FIG. 4 illustrates the peripheral mechanisms of the sheet holder lever 78.

In FIG. 6 and FIG. 7, the sheet holder lever 78 positions (1), (2), (3) and (4) are detected by the sheet stacking amount detection sensors 85*a* and 85*b* (sheet holding lever sensors) in FIG. 4. In other words, the first sheet stacking amount detection sensors 85*a* and the second sheet stacking amount detection sensors 85*b* detect the height of the sheets stacked on the stacking tray 15 at a plurality of levels.

The sheet holder lever 78 position (1) is where it is stored inside of the sheet abutting member 12*a* and the first sheet stacking amount detection sensors 85*a* is OFF, the second sheet stacking amount detection sensors 85*b* sheet surface detection sensor is ON.

The sheet holder lever 78 position (2) is where the sheet S is detected to be stacked on the stacking tray 15, and the first sheet stacking amount detection sensors 85*a* is ON, the second sheet stacking amount detection sensors 85*b* sheet surface detection sensor is ON.

The sheet holder lever 78 position (3) is the home position, and the first sheet stacking amount detection sensors 85*a* is ON, the second sheet stacking amount detection sensors 85*b* sheet surface detection sensor is OFF.

The sheet holder lever 78 position (4) is where the sheet S is detected to be removed, and the first sheet stacking amount detection sensors 85*a* is OFF, the second sheet stacking amount detection sensors 85*b* sheet surface detection sensor is OFF.

FIG. 4 shows the appropriate position for the sheet holder lever 78 to hold the sheet S, or in other words, positioned at the home position of (3).

From this state, each time the sheet S is sequentially discharged to the stacking tray 15, the sheet holder lever 78 reciprocally moves between the stored position of (1) to the home position of (3), or the positions of dotted lines shown in FIG. 4.

Furthermore, as the sheet S is stacked on the stacking tray 15, the detection flag 79 moves in the clockwise direction, the first flag 79*a* on the detection flag 79 is detected by the first sheet stacking amount detection sensors 85*a* and turns ON, the second flag 79*b* on the detection flag 79 is detected by the sheet stacking amount detection sensors 85*b* and turns ON. At this point, the signal to lower the stacking tray 15 is output from the microprocessor 11A on the finisher apparatus 11 and based on this signal, the motor M (not shown in the drawings) lowers the stacking tray 15 for a predetermined amount.

The combination of these signals (2 bits) of the sheet holder lever sensor and sheet surface detection sensor being ON and OFF are taken in by the microprocessor (MPU) 11 on the finisher apparatus 11 to recognize the status of the sheets stacked on the stacking tray 15 (including the absence of sheets) to execute the following controls.

In the following ordinary operations, at the (1) position, it executes to lower the stacking tray 15, at (2), it controls to lower the stacking tray 15. Furthermore, at position (3), because it is at the home position, it controls the stacking tray 15 to stop. At position (4), it controls to raise the stacking tray 15.

In this operation, while transporting the sheet S from the microprocessor GA on the image forming apparatus G, the shift operation request signal (which here is stabling in the aforementioned shift operation) is sent to the microprocessor 1A on the finisher apparatus 11. The shift operation mode and the straight operation mode switch according to this signal. The holding lever solenoid 83 operates with the drive signal from the microprocessor 11A.

In this operation, the sheet holder lever 78 protrudes and if it is not positioned at the home position after a prescribed amount of time, it moves to the home position. At this time, in the shift request, if the sheet S is a comparatively large size (for example, the length of 300 mm in the transport direction), the stacking tray 15 is raised from the home position. Then, after the shift operation is completed, the stacking tray 15 is controlled to lower to the home position.

The control to raise the stacking tray 15 from the home position is performed from the first sheet to a plurality of the sheet S, then the sheet S is received from the stacking tray 15 at the home position to execute the shift operation. In other words, after discharging the first sheet or a plurality of the sheet S, by receiving more discharged sheet S from the stacking tray 15 at the home position, the sheet S will drop into the stacking tray 15, causing the problem of an improper shift operation.

Note that the height of the stacking tray 15 is variably controlled and the angle of inclination of the stacking tray 15 is also controlled.

The following will describe the variable control of the height of the stacking tray 15 and control of the angle of inclination of the stacking tray 15 with a fist and second embodiment.

In the first embodiment, the height of the stacking tray 15 is controlled according to the number of the sheet S.

In the second embodiment, the angle of the inclination of the stacking tray 15 is variably controlled when discharging the sheet S and the sheet S bundle.

(1) First Embodiment

FIG. 8 is a flowchart representing the general procedures for processing of the first embodiment.

In FIG. 8, the stacking tray 15 position is controlled to a high position as described below for the upward curl of the sheet S. First, the microprocessor 11A on the finisher apparatus 11 determines whether or not the sheet S is discharged (step S11), if no sheet S is discharged (No), it determines that it is a sheet S bundle (shift mode) (step S12). If no sheet S bundle is discharged (No), it returns to step S11 and idles. At step S12, if a sheet S bundle has been discharged (No), the stacking tray 15 is lowered (step S13). Then, when it reaches the home position (step S14), it stops the stacking tray 15 (step S15).

At step S11, if a sheet S is discharged (Yes), it is determined whether it is the first sheet in a sheet S bundle to be discharged (step S16). If it is not the first sheet (No), it proceeds to step S15 to stop the stacking tray 15. If at step S16, it is the first sheet (Yes), a predetermined timer (pulse count values) is set (step S17) from the rise to the stop of the stacking tray 15. Also, the stacking tray 15 is raised (step S18) and by a time-up at the set value (step S19), it proceeds to step S14 with the stacking tray 15 stopped.

Note that in this example only the first sheet is determined at step S16, it is also perfectly acceptable to determine the fifth sheet, for example for a preset number of a plurality of sheets. This can also be set according to the characteristics of the sheet S and to the status of the curls therein.

By controlling the raising of the stacking tray 15, the downstream edge of the sheet S is lifted, as shown in the FIG. 12 described below, the upward curl of the sheet S at this opposite end touching the endless transport belt 28. The rotation of the endless transport belt 28, pulls in the direction indicated by the arrow, and as shown in FIG. 13, described below, stacks on a predetermined position on the processing tray 39.

Figure 9:
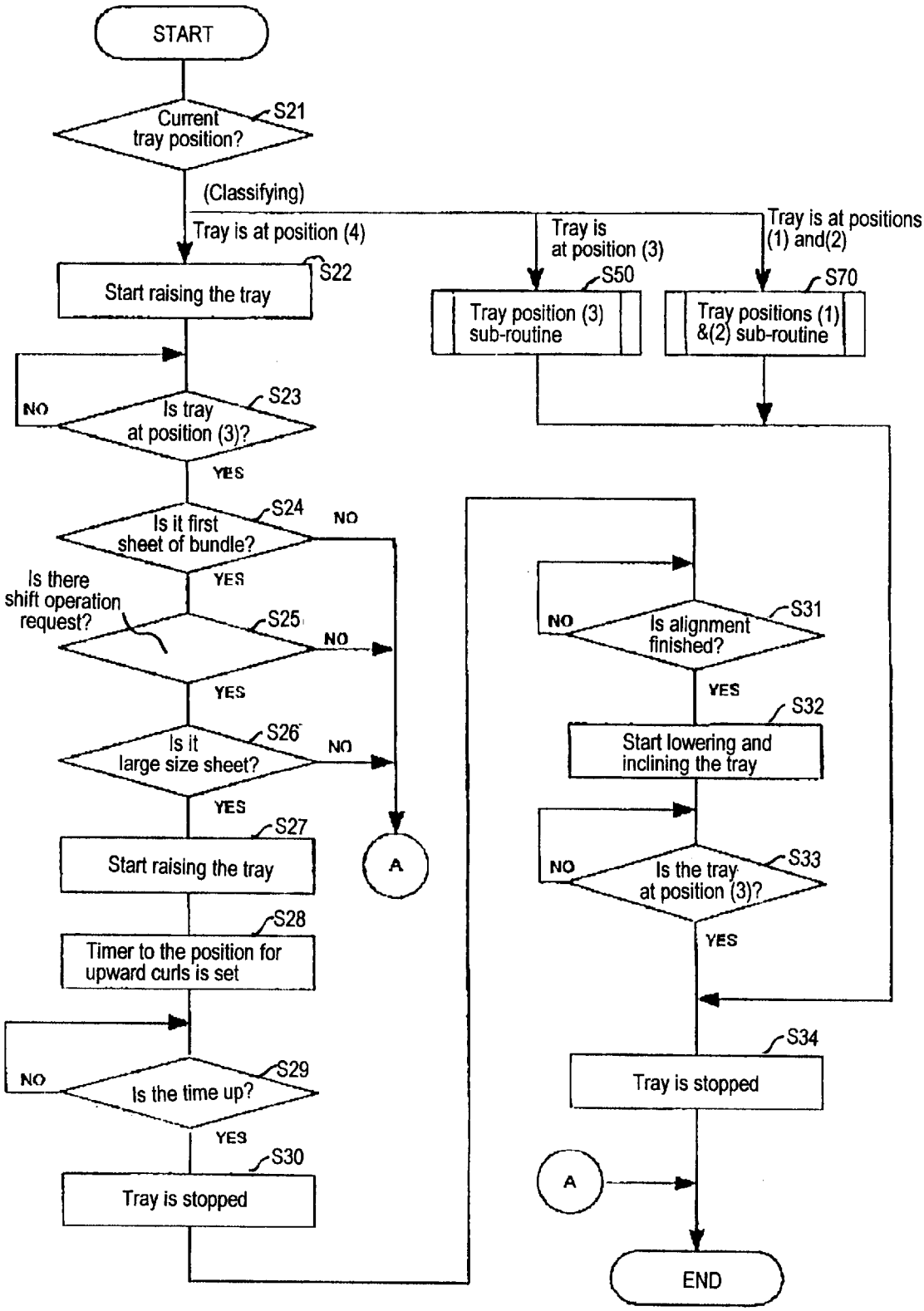
FIG. 9 is a flowchart representing the detailed processing procedures for the second embodiment.
Figure 10:
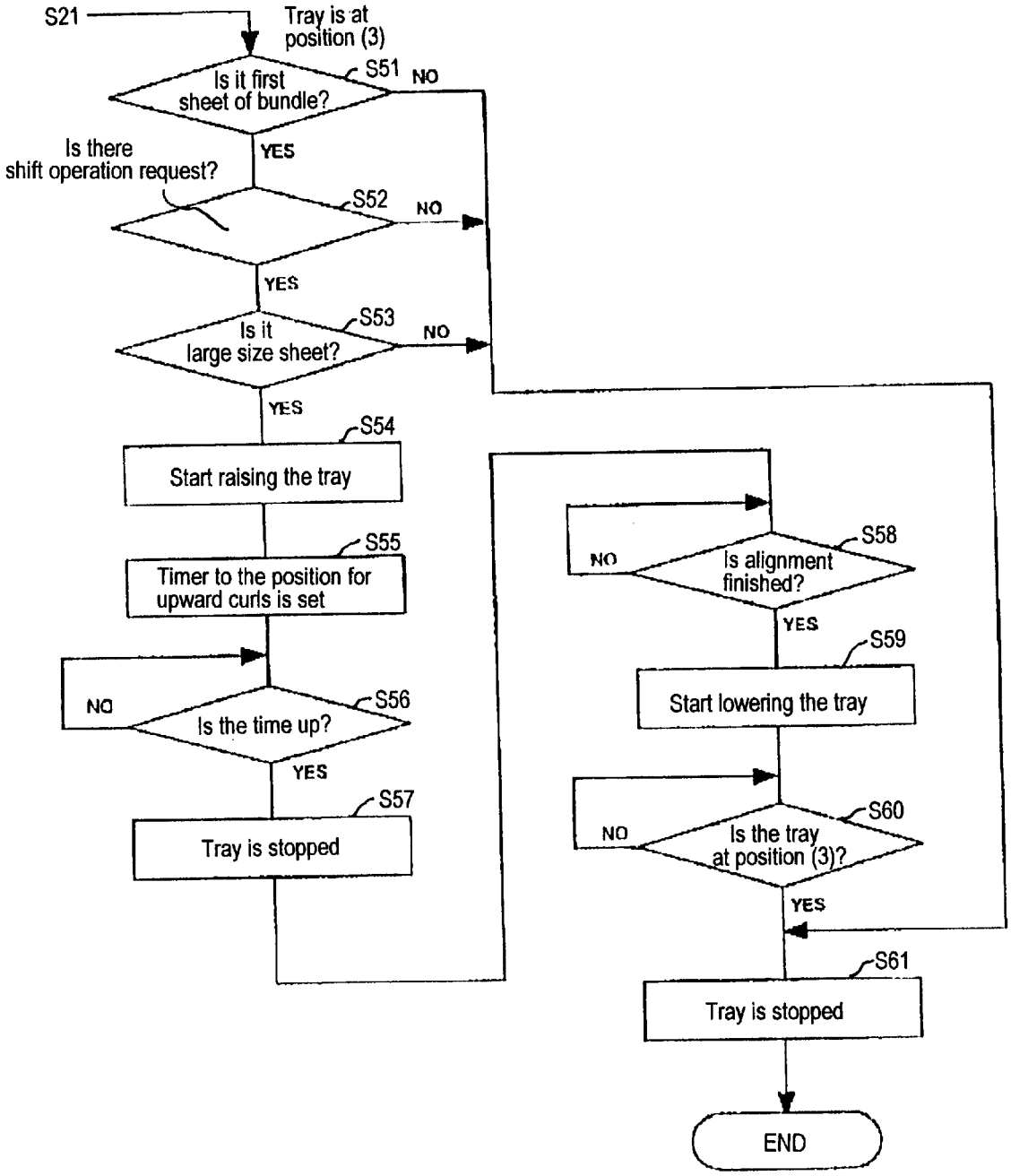
FIG. 10 is a flowchart representing the processing procedures for the sub-routine of FIG. 8.
Figure 11:
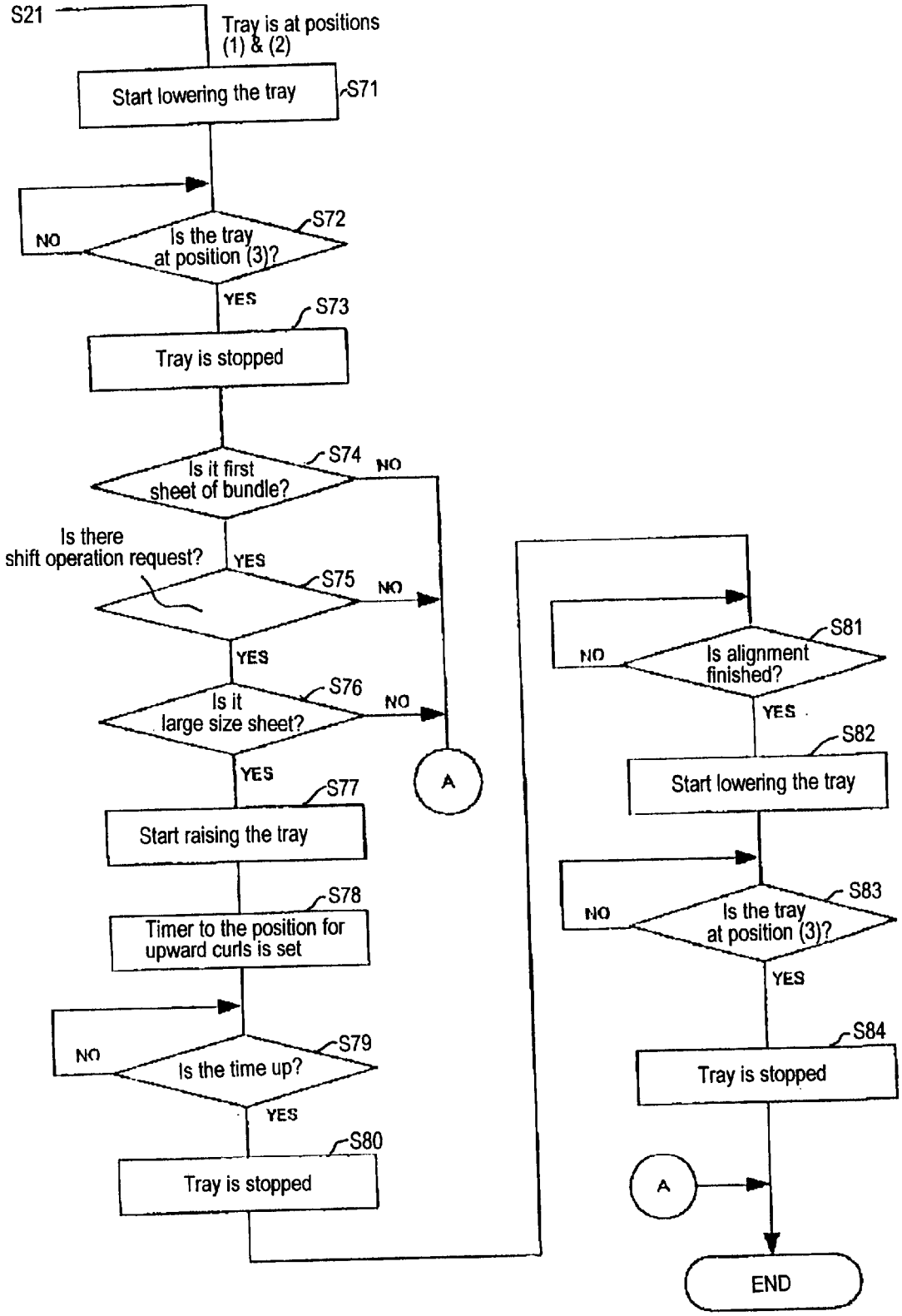
FIG. 11 is a flowchart representing other sub-routine processing procedures of FIG. 8.

FIG. 9 is a flowchart representing the detailed processing procedures for the first embodiment. FIG. 10 is a flowchart representing the sub-routine processing procedures of those in FIG. 9, FIG. 11 is a flowchart representing the other sub-routine processing procedures of those in FIG. 9.

In FIG. 9, the microprocessor 11A on the finisher apparatus 11 recognizes the position of the stacking tray 15 with the signals (ON or OFF) output from the sheet stacking amount detection sensors 85 (the sheet holder lever sensor) and the sheet presence sensor 40 (sheet surface detection sensor) indicated in FIG. 6 and FIG. 7.

The position (1) for the stacking tray 15 is when the sheet S is in the stacking tray 15 (no sheets). Also, the position (2) is where the sheet S is detected to be stacked in the stacking tray 15 and the position (3) is the home position. The position (4) is where the sheet S is detected to have been removed.

At step S21, the position (4) and the position (3) (step S50) and the position (1) and (2) (step S70) are identified and the appropriate steps are taken.

When the position (4) at step S21 is recognized, the microprocessor 11A executes a control to raise the stacking tray 15 (step S22) With the stacking tray 15 raised, it determines that the stacking tray 15 has reached the home position (3) and determines if the next sheet S is the first sheet of the bundle (step S23 and S24). If it is the first sheet of the sheet S bundle (Yes), it is determined whether the shift operation request is taken in from the image forming apparatus G. If the shift operation request has been taken in (Yes), next the size of the sheet S is determined by sheet size determination means (for example 300 mm in length in the direction of transport) (step S25 and step S26). If the sheet S size is small, it is unnecessary to control to change the stacking tray 15 position for the upward curl thereof.

Note that in this example only the first sheet is determined at step S16, but that it is also perfectly acceptable to determine the fifth sheet, for example for a preset number of a plurality of sheets. This is also set according to the characteristics of the sheet S and to the status of the curls therein.

In this case, the process is completed when there is a No at steps S24 to S26. For a large size (Yes) at step S26, a control is executed to raise the stacking tray 15 position (step S27). The following describes in detail the raised position (the position for upward curls) according to FIG. 12 to FIG. 16.

After starting to raise the stacking tray 15 position, a timer is set up to the position of the upward curl (step S28). Next, when the time is up, the stacking tray 15 position is stopped (steps S29 and S30). Next, it is determined to align the sheet S (the stack on the processing tray unit 30) (step S31), the stacking tray 15 position is lowered (step S32) and when it reaches the home position (3), the stacking tray 15 is stopped (steps S33 and S34).

In FIG. 10, at the position (3) (step S50), it is determined whether the sheet S is the first sheet of the sheet S bundle (step S51) with the same routine as shown in FIG. 9 (steps 24 to S34). Next, it is determined whether the shift operation mode request has been taken in from the image forming apparatus and determines that the sheet S is a large size sheet. A control is executed to raise the stacking tray 15 position (steps S52, S53 and S54).

Next, the timer is set up to the position for the upward curl, the stacking tray 15 position is stopped, and it is determined to align the sheet S (the stack on the processing tray unit 30) (steps S55, S56, S57 and S58). Next, the stacking tray 15 position is lowered and when it reaches the home position (3), the stacking tray 15 is stopped (steps S59, S50 and S61).

In FIG. 11, at the positions (1) and (2) (step S70), first the microprocessor 11A executes (step S71) a control to lower the stacking tray 15. With the stacking tray 15 raised, it is determined that the stacking tray 15 has reached the home position (3) and the stacking tray 15 is stopped (step S72 and S73). After this, it is determined whether it is the first sheet of the sheet S (step S74) in the same routine as in FIG. 9 (steps S24 to S34). Next, it is determined whether the shift operation mode request has been taken in from the image forming apparatus and determines that the sheet is a large size sheet. A control is executed to raise the stacking tray 15 position (steps S75, S76 and S77).

Next, the timer is set up to the position for the upward curl, the stacking tray 15 position is stopped, and it is determined to align the sheet S (the stack on the processing tray unit 30) (steps S78, S79, S80 and S81). Next, the stacking tray 15 position is lowered and when it reaches the home position (3), the stacking tray 15 is stopped (steps S82, S83 and S84).

The following shall describe the position for upward curls on the stacking tray 15. FIG. 12 is a side view to illustrate the first position for upward curls, FIG. 13 is a side view to illustrate the first position for upward curls in continuation to FIG. 12.

Figure 12:
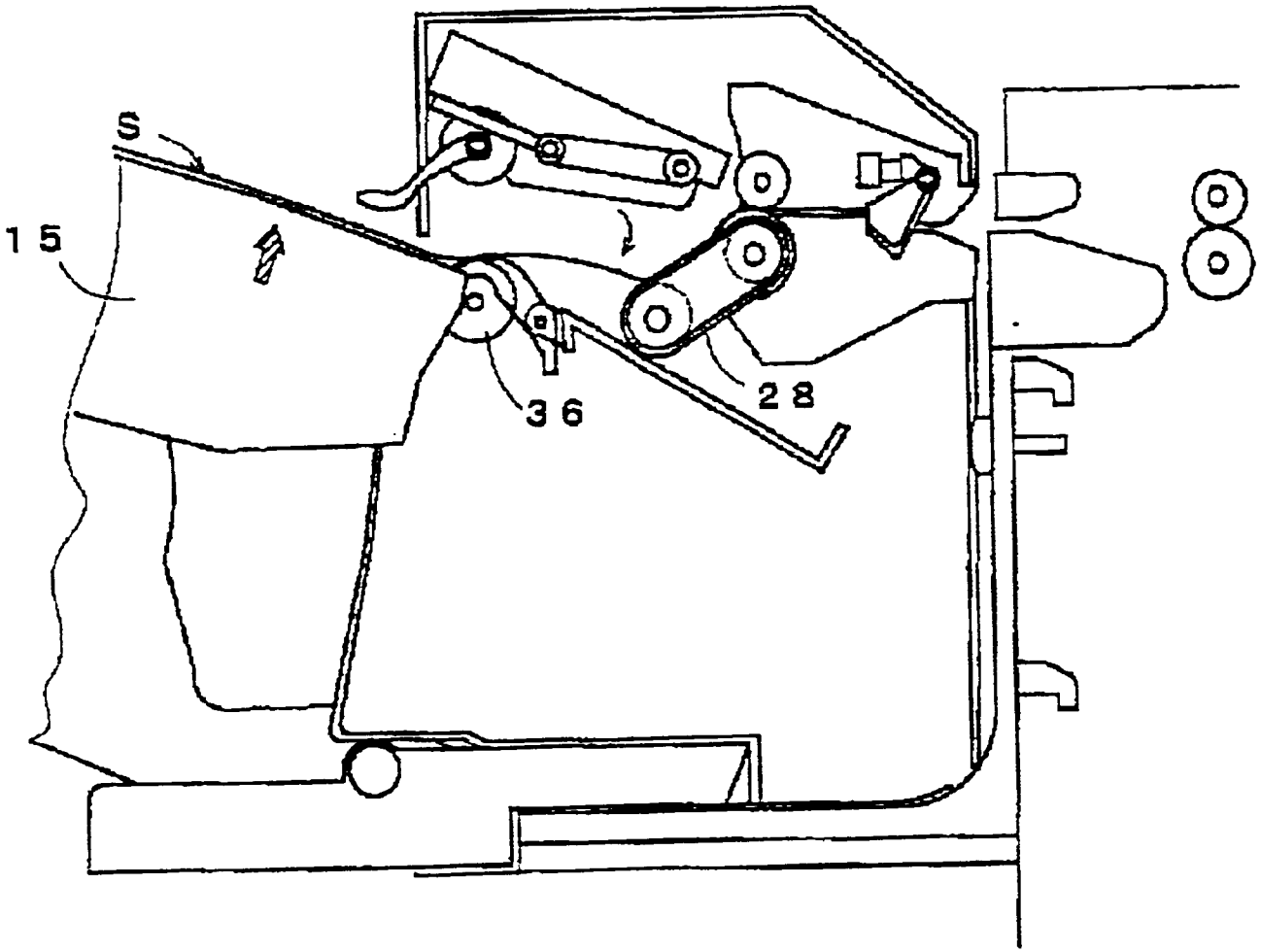
FIG. 12 is a side view to illustrate the first upward curl countering position of an embodiment of the present invention.
Figure 13:
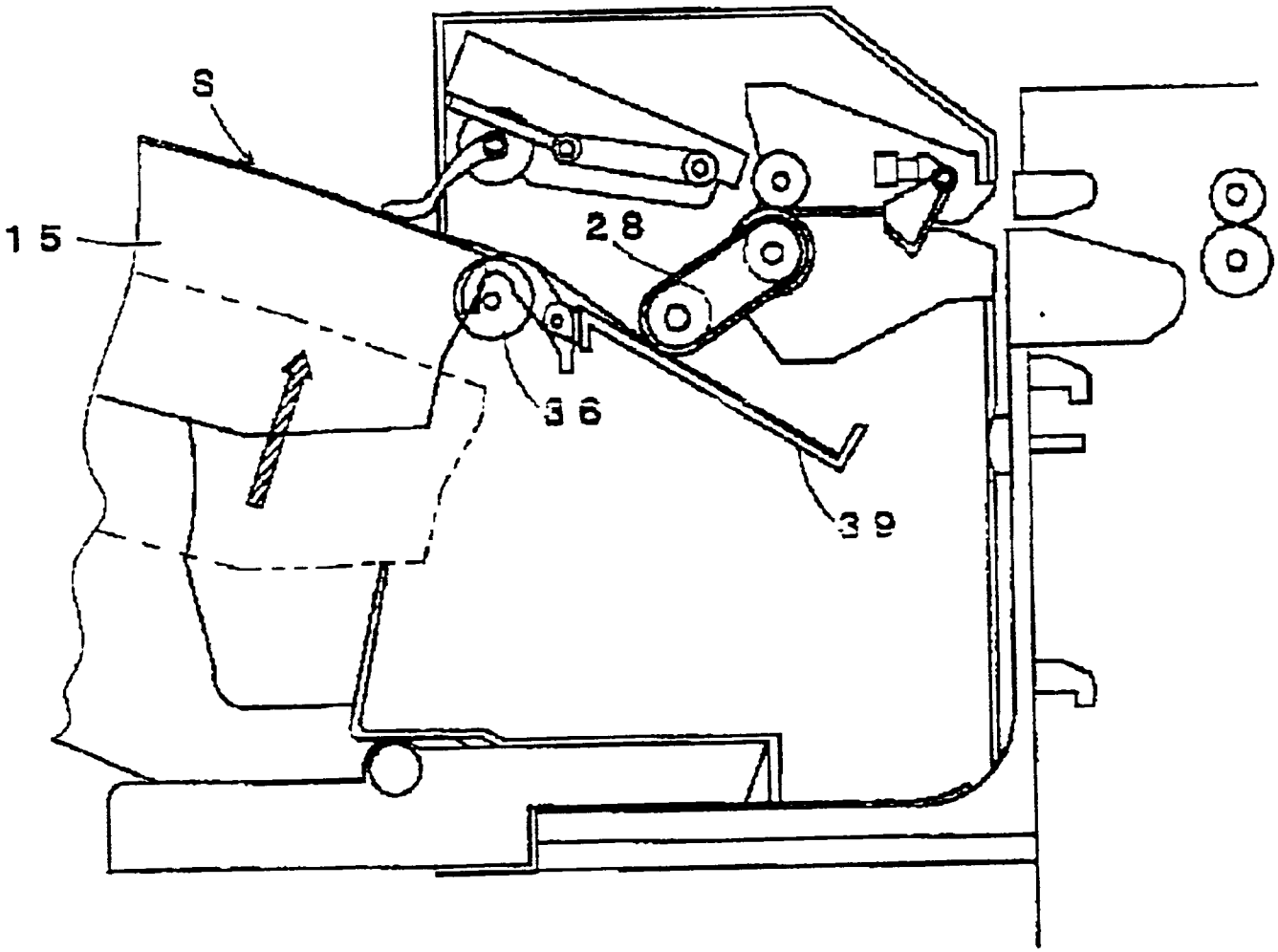
FIG. 13 is a side view to illustrate a further example of the first upward curl countering position of an embodiment of the present invention.

In FIG. 12 and FIG. 13, by controlling the raising of the stacking tray 15, the downstream edge of the sheet S is lifted, so the upward curl of the sheet S at the upstream edge touches the endless transport belt 28. The rotation of the endless transport belt 28, pulls in the direction indicated by the arrow and stacks on a predetermined position on the processing tray 39, as shown in FIG. 13.

Figure 14:
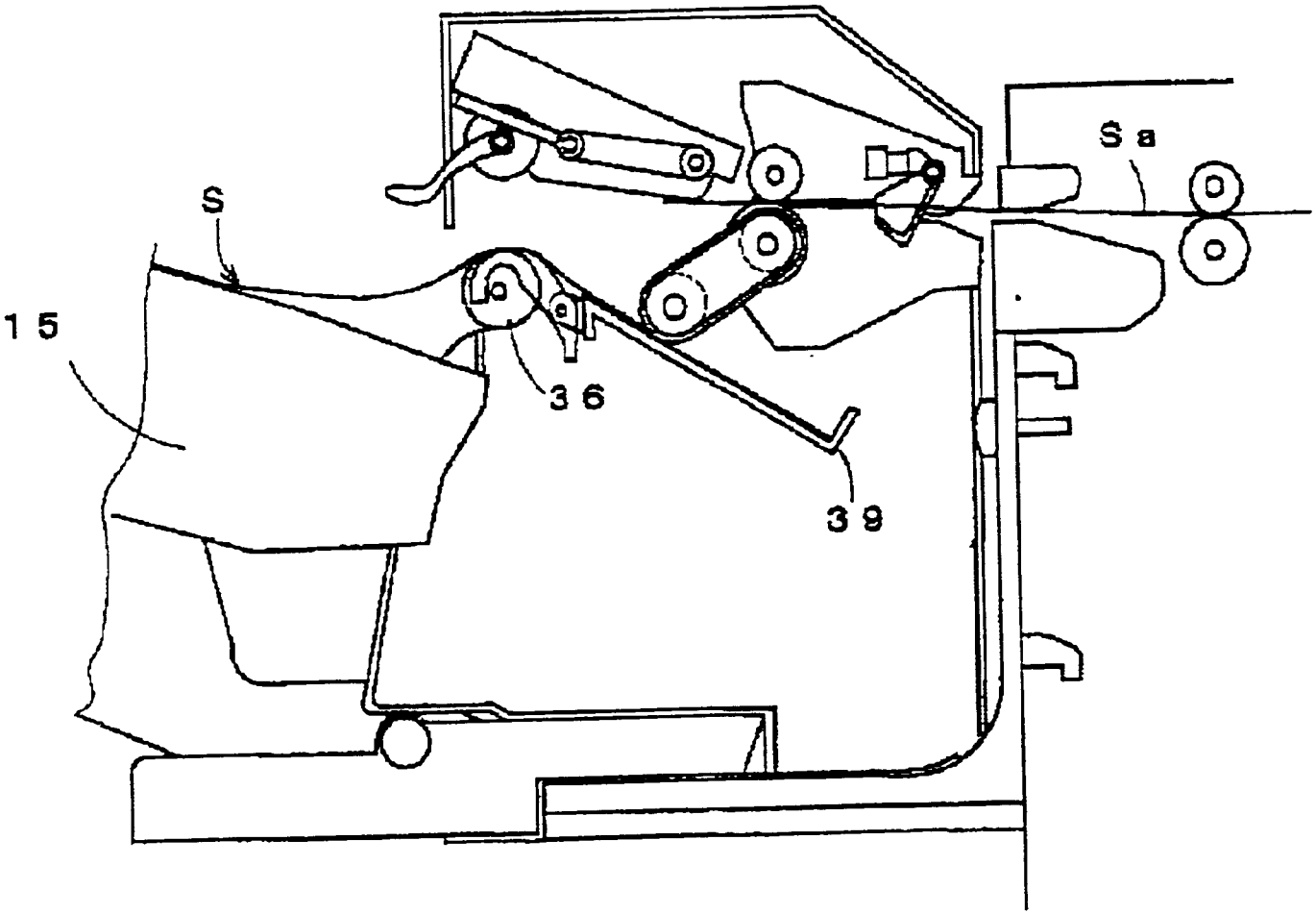
FIG. 14 is a side view to illustrate the second upward curl countering position of an embodiment of the present invention.

FIG. 14 is a side view to illustrate the second position of the stacking tray 15 for upward curl. In FIG. 14, the position of the stacking tray 15 in this example is arranged in a position lower than the discharge roller 36. At this position of the stacking tray 15, the downstream edge of the sheet S is stacked on the stacking tray 15 and the central region of the sheet S is laid on the discharge roller 36, the upstream edge of the sheet S being stacked at a determined position on the processing tray 39. Next, when the second sheet S is arranged on top of the first sheet S, it is easily arranged at a determined position on the processing tray 39 without any sagging occurring therein.

Figure 15:
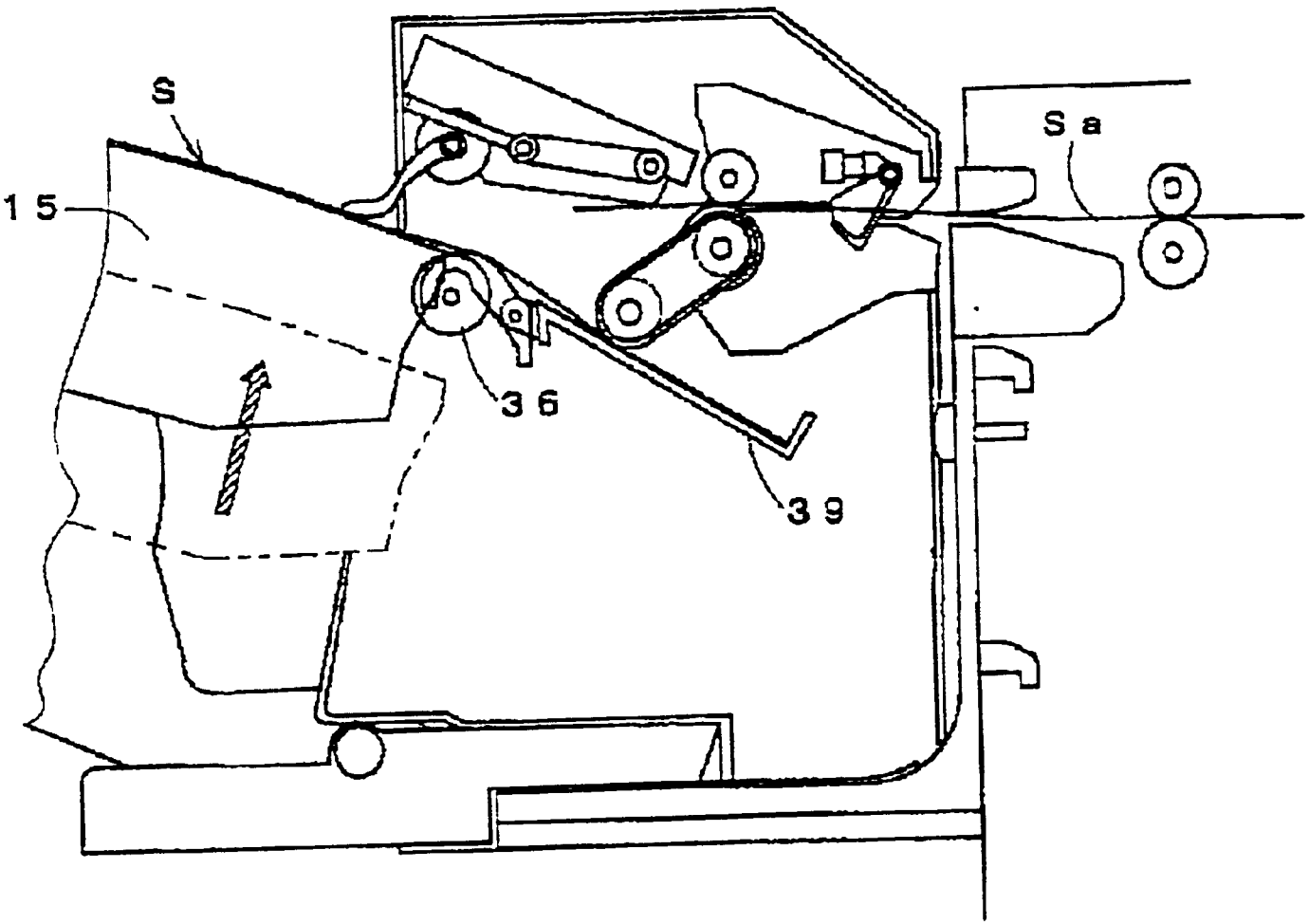
FIG. 15 is a side view to illustrate the third upward curl countering position of an embodiment of the present invention.
Figure 16:
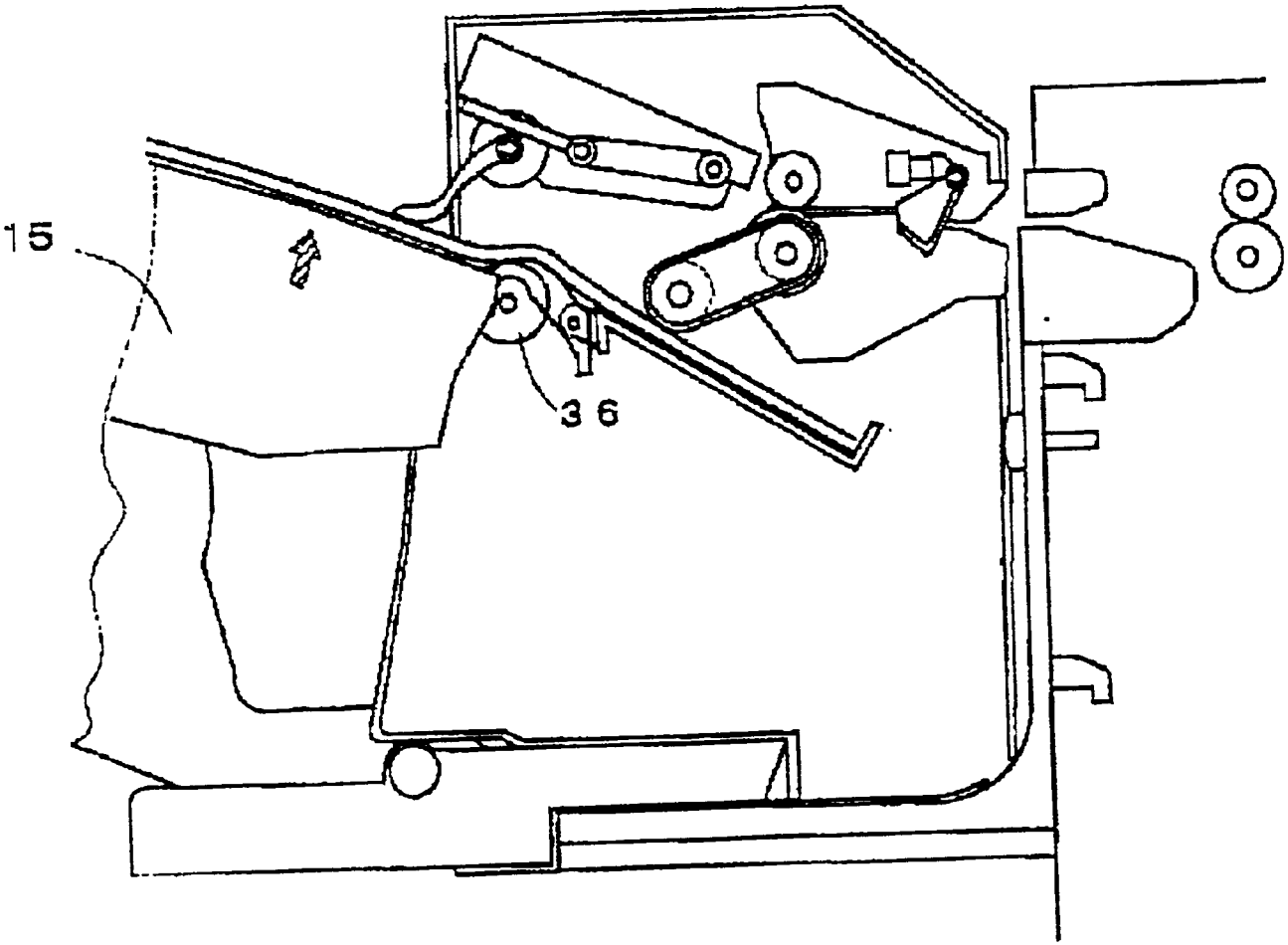
FIG. 16 is a side view to illustrate a further example of the third upward curl countering position of an embodiment of the present invention.

FIG. 15 is a side view to illustrate the third position for upward curls, FIG. 16 is a side view to illustrate the third position for upward curls in continuation to FIG. 15.

In FIG. 15, the stacking tray 15 position is set so that the upstream side from the downstream side of the sheet S on the discharge roller 36 is arranged in a direct line with the stacking tray 15 and the processing tray 39. In this case, the sheet S is arranged so that the endless transport belt 28 can easily pull the sheet S into the processing tray 39. As shown in FIG. 16, the sheet S to a determined number of sheets after the second sheet are arranged to be pulled into the processing tray 39 by the endless transport belt 28 in the same way.

Figure 17:
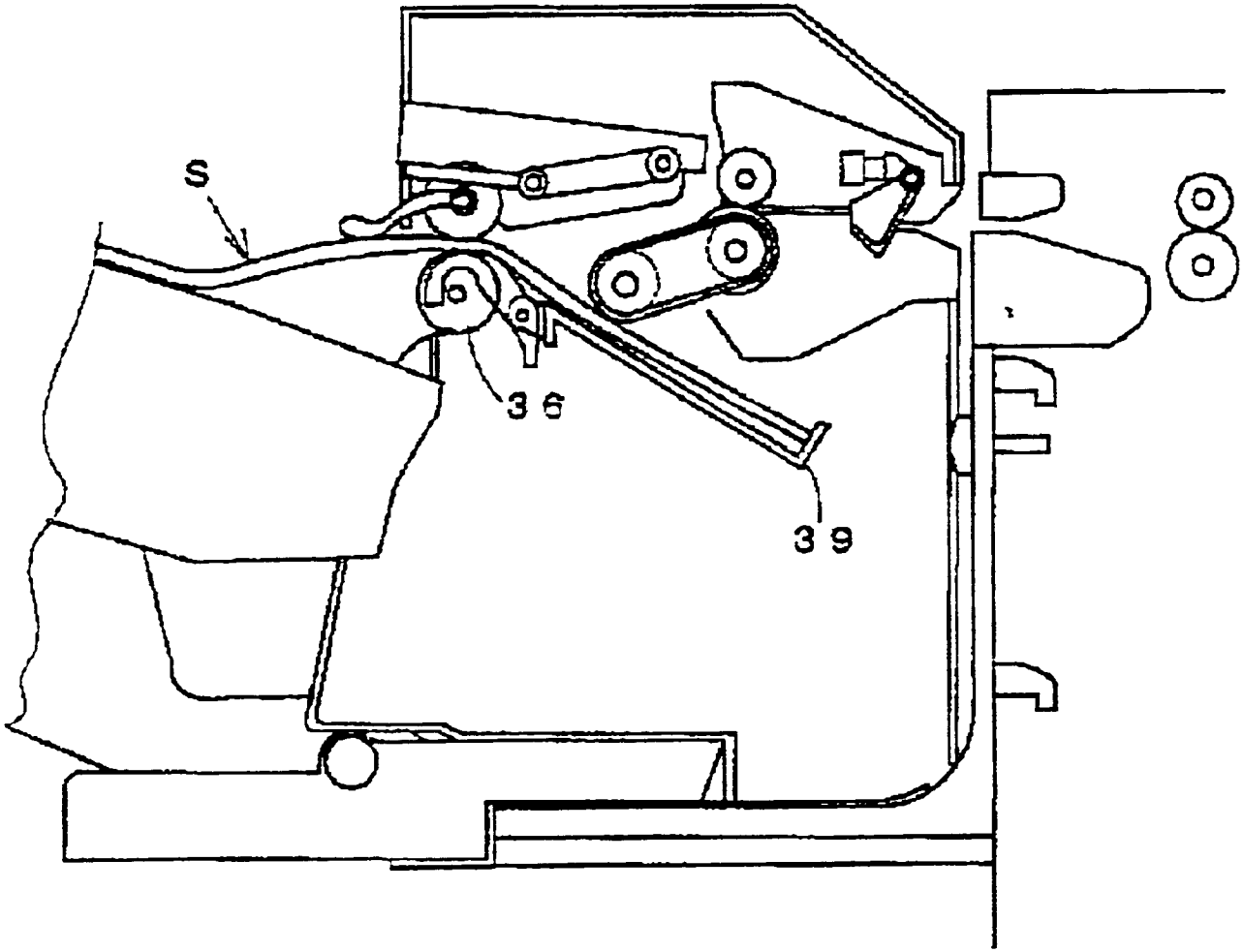
FIG. 17 is a side view to illustrate the stacking tray position when discharging sheet bundles from the stacking tray in an embodiment of the invention.

FIG. 17 is a side view to illustrate the stacking tray 15 position when discharging a sheet S bundle. In FIG. 17, the position of the stacking tray 15 is arranged in a position lower than the discharge roller 36 when discharging the sheet S bundle. In this state, the sheet S bundle is discharged into the stacking tray 15 by the follower discharge roller 25 (the bundle discharge roller). In this case, the sheet S is discharged to hang into the stacking tray 15 with the weight of the leading edge of the sheet S bundle.

Second Embodiment

Figure 18:
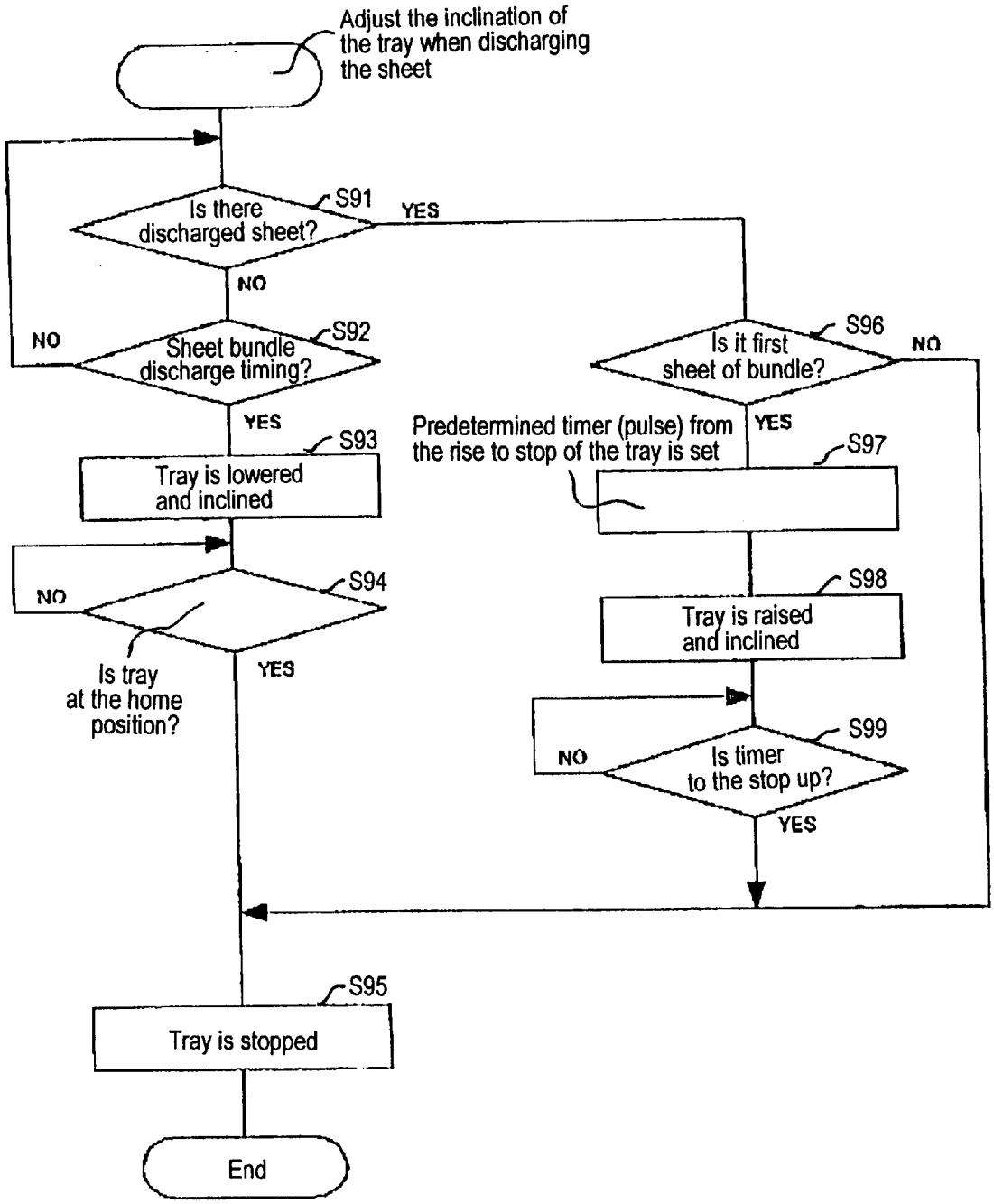
FIG. 18 is a flowchart representing the general procedures for processing of the second embodiment of the present invention.

FIG. 18 is a flowchart representing the general procedures for processing of the second embodiment.

In FIG. 18, the stacking tray 15 position is set to a high position to counter upward curls of the sheet S in the same way as the first embodiment in FIG. 8, but the angle of incline of the stacking tray 15 is controlled. This inclination is set to face the discharge roller 36 side toward the lower side or conversely setting to face the discharge roller 36 side toward the upper side or to set the stacking tray 15 sheet S stacking surface to be horizontal. This makes it easier for the endless transport belt 28 to pull the sheet S into the processing tray 39 in correspondence to the weight of the paper or the status of the upward curl of the paper.

In FIG. 18, it is determined whether or not the sheet S is discharged or not, in the same manner as in FIG. 8, and whether a sheet S bundle is discharged. The stacking tray 15 is lowered or the angle of incline is set as described above (step S93). Then, the stacking tray 15 is stopped at the home position (steps S94 and S95).

If at step S91, the sheet S is to be discharged (Yes), it is determined whether it is the first sheet in a sheet S bundle to be discharged and a predetermined timer (pulse count values) (steps S96 and S97) is set from the rise to the stop of the stacking tray 15. Next, the stacking tray 15 is raised and the aforementioned angle of incline is set. Furthermore, after the time is up at the set value (steps S98 and S99), it proceeds to step S14 to stop the stacking tray 15.

Figure 19:
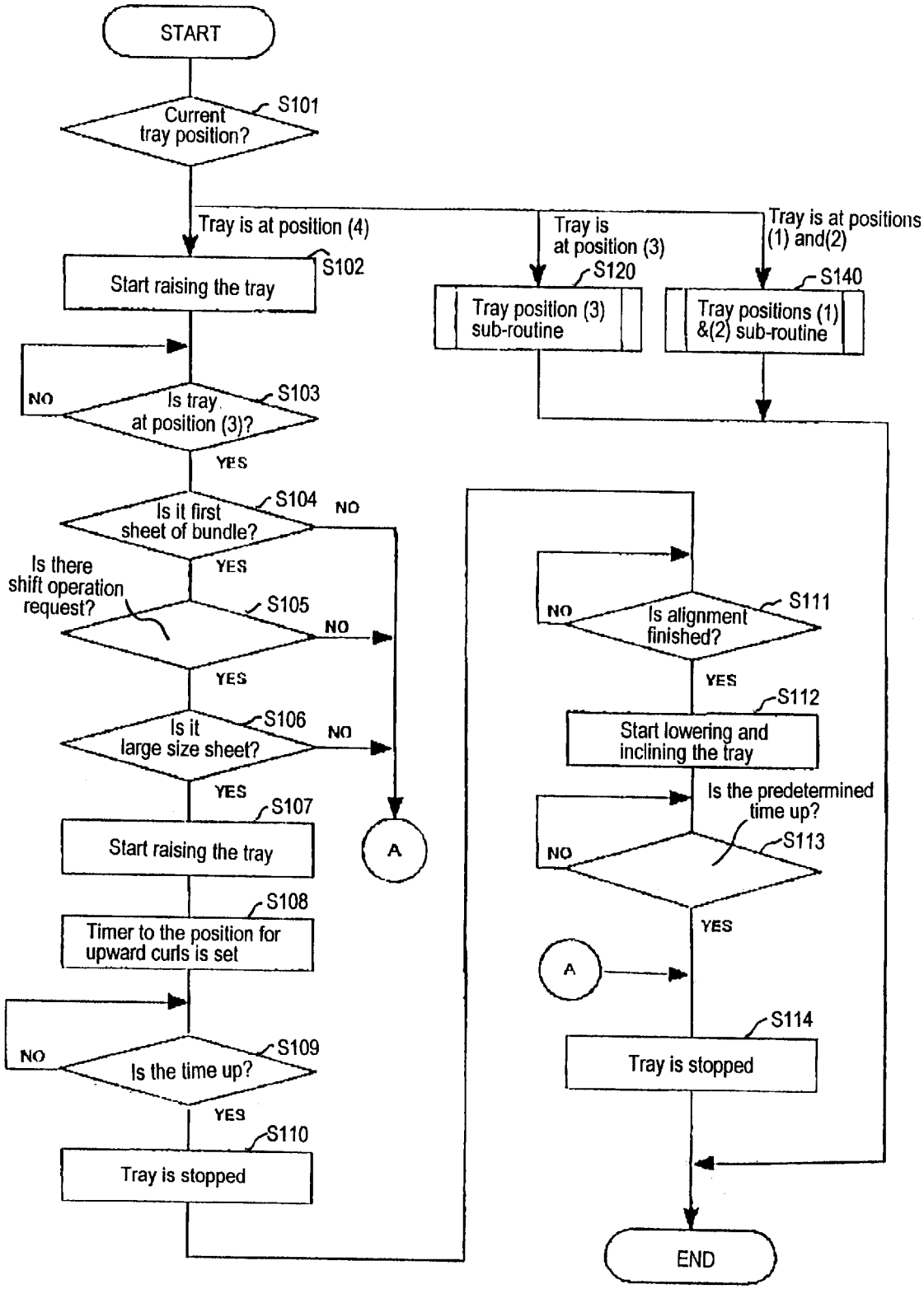
FIG. 19 is a flowchart representing the detailed processing procedures for the second embodiment of the present invention.
Figure 20:
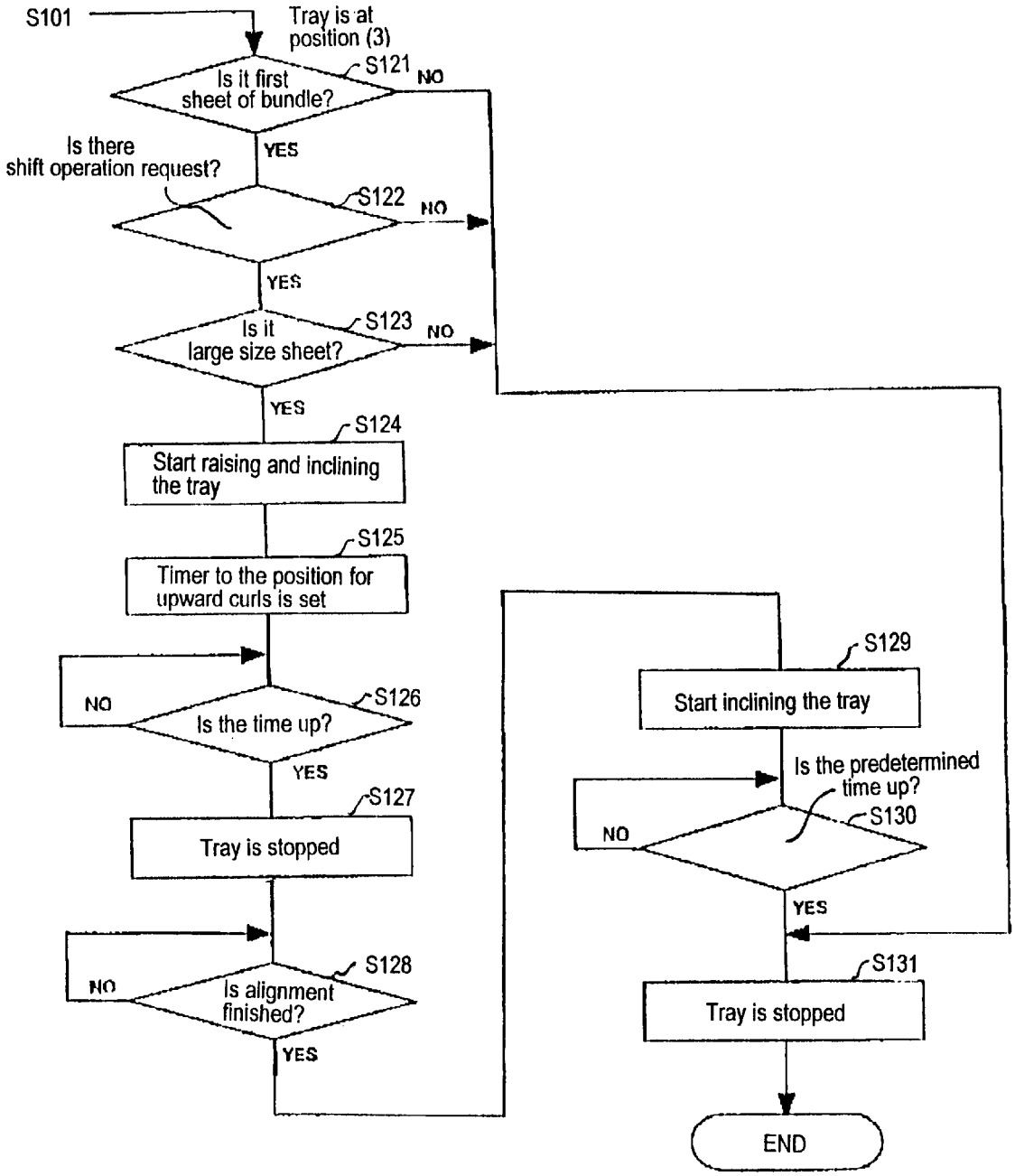
FIG. 20 is a flowchart representing the processing procedures for the sub-routine of FIG. 19.
Figure 21:
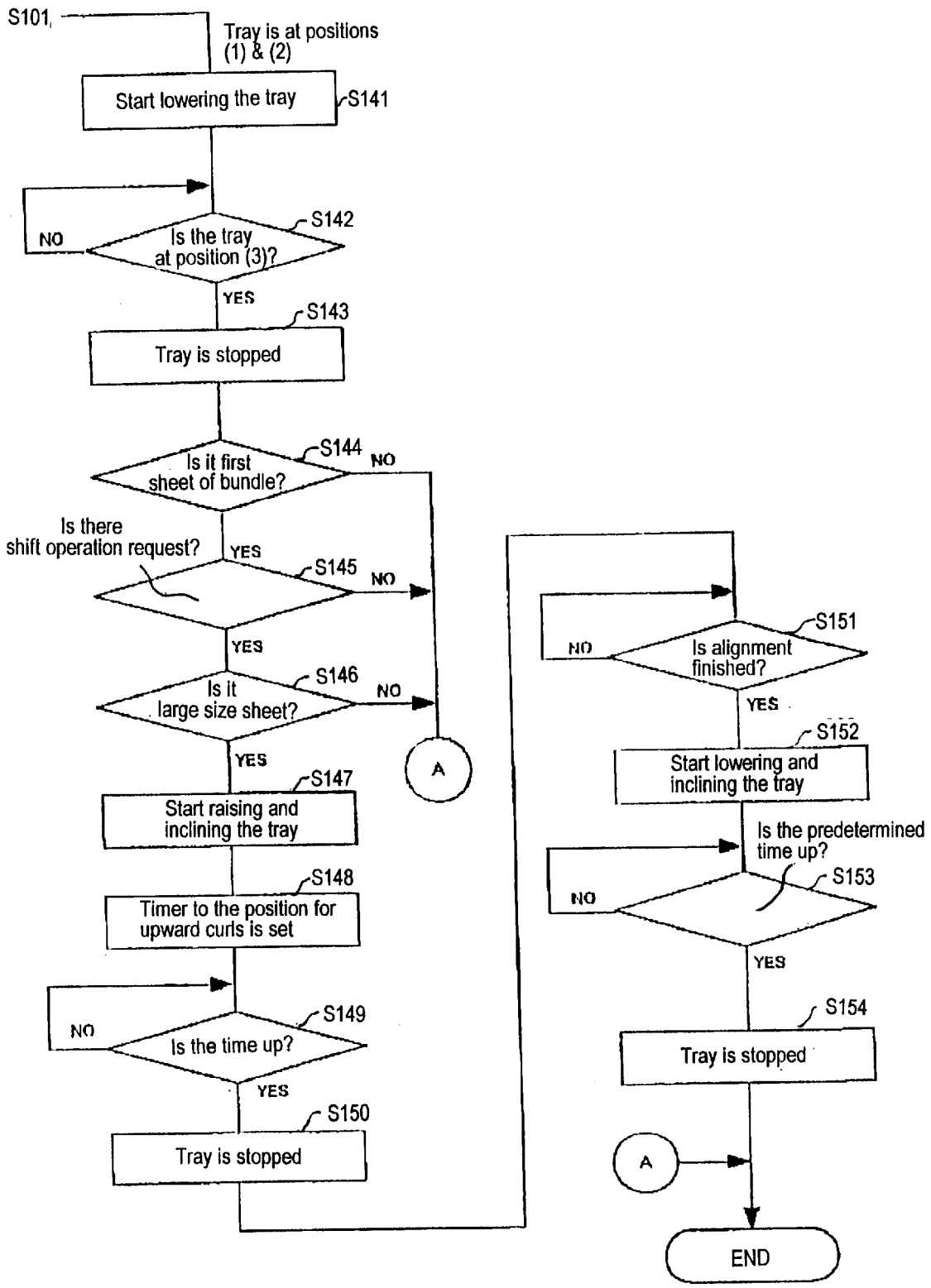
FIG. 21 is a flowchart representing other sub-routine processing procedures of FIG. 19.

FIG. 19 is a flowchart representing the detailed processing procedures for the second embodiment. FIG. 20 is a flowchart representing the sub-routine processing procedures of those in FIG. 19, FIG. 21 is a flowchart representing the other sub-routine processing procedures of those in FIG. 19.

In FIG. 19, in the same manner as the first embodiment in FIG. 9, the stacking tray 15 positions (1), (2), (3) and (4) are recognized (step S101).

If the position (1) is recognized at step S21, the stacking tray 15 is raised. It is determined while raising whether the stacking tray 15 has reached the home position of (3). Next, it is determined whether or not it is the first sheet of the sheet S bundle (steps S102, S103 and S104). Next, it is determined if the shift operation mode request has been taken in from the image forming apparatus and it is determined that the sheet S is a large size sheet (steps S105 and S106). Further, the stacking tray 15 position is raised and a control is stated to set the aforementioned angle of incline and a timer is set for a position to counter for the upward curl of the paper. When the time is up, the stacking tray 15 position is stopped (steps S107, S108, S109 and S110). Later, it is determined whether or not to align the sheet S (the stack on the processing tray unit 30) (step S111). Next, the stacking tray 15 position is lowered and the angle of incline is set (step S112). When the time is up, the stacking tray 15 is stopped (steps S113 and S114).

In FIG. 20, at the position (3) in step S120 in FIG. 19, it is determined whether it is the first sheet of a sheet S bundle in the same manner as was used in the routine of FIG. 19 (steps S104 to S1114), it is determined whether the shift operation request was taken in from the image forming apparatus G and it is determined that the sheet S is a large size. A control is executed to raise the stacking tray 15 position and to set the angle of incline (steps S121, S122, S123 and S124).

Next, the timer is set to the position to counter for the upward curl, the stacking tray 15 position is stopped, and it is determined to align the sheet S (steps S125, S126, S127 and S128). Next, the stacking tray 15 position is lowered and the angle of incline is set. When the determined time is up, the stacking tray 15 is stopped (steps S129, S130 and S131).

In FIG. 21, at the positions (1) and (2) of step S140 in FIG. 19, first the microprocessor 11A executes (step S141) a control to lower of the stacking tray 15. It is determined whether the stacking tray 15 has reached the home position (3) while raising and the stacking tray 15 is stopped (step S142 and S143).

After this, it is determined whether it is the first sheet of the sheet S (step S144) in the same routine as in FIG. 19 (steps S104 to S114). Next, it is determined whether the shift operation mode request has been taken in from the image forming apparatus and it is determined that the sheet S is a large size. A control is executed to raise and to incline the stacking tray 15 position (steps S145, S146 and S147).

Next, the timer is set to the position to counter for the upward curl, the stacking tray 15 position is stopped, and it is determined to align the sheet S (steps S148, S149, S150 and S151). Next, the stacking tray 15 position is lowered and the angle of incline is set. When the time is up, the stacking tray 15 is stopped (steps S152, S153, and S154).

Note that in the second embodiment, only the first sheet of the sheet S is determined but it is also perfectly acceptable to determine the fifth sheet, for example for a preset number of a plurality of sheets. This is also set according to the characteristics of the sheet S and to the status of the curls therein.

As described in detail above, the sheet discharge control method and the sheet discharge apparatus according to the present invention controls the height and the inclination of the stacking tray according to the number of sheets discharged thereto and it controls the height and the inclination of the stacking tray when discharging sheets and sheet bundles. The result is vastly improved alignment of discharged sheets and transporting characteristics.

What is claimed is:

1. A sheet discharge apparatus comprising:

discharge means for discharging a sheet received from an image forming apparatus;

support means disposed downstream of said discharge means in a direction of sheet discharge;

storage means disposed downstream of said support means in the direction of sheet discharge;

moving means for moving said sheet in a state straddling said support means and said storage means discharged by said discharge means to said storage means;

elevator means for raising and lowering said storage means relative to the supporting means;

sheet size determination means for determining a sheet size of the sheet discharged from the discharge means; and control means for controlling said elevator means to vary a position of said storage means with regard to said support means when the sheet discharged by said discharge means is determined to be greater than a predetermined size by the sheet size determination means.

2. A sheet discharge apparatus according to claim 1, wherein said control means controls said elevator means to lower the relative position of said storage means with regard to said support means after a determined number of sheets are discharged by said discharge means.

3. A sheet discharge apparatus according to claim 1, wherein said control means controls said elevator means to make a downstream edge in a transport direction of the sheet discharged by said discharge means higher than a highest level of said support means until a determined number of sheets are discharged by said discharge means.

4. The A sheet discharge apparatus according to claim 1, wherein said control means controls said elevator means to change the position corresponding to a number of sheets discharged by the discharge means.

5. A sheet discharge apparatus comprising:

discharge means for discharging a sheet received from an image forming apparatus;

support means disposed downstream of said discharge means in a direction of sheet discharge;

storage means disposed downstream of said support means in the direction of sheet discharge;

moving means for moving said sheet in a state straddling said support means and said storage means discharged by said discharge means to said storage means;

inclining means for varying a relative angle of incline between said support means and said storage means; and control means for controlling said inclining means so that the angle of incline of said storage means with regard to said support means corresponds to a number of sheets discharged by said discharge means.

6. A sheet discharge apparatus according to claim 5, wherein said control means controls said inclining means so that the angle of incline of said storage means is smaller with regard to said support means after a determined number of sheets are discharged by said discharge means.

7. A sheet discharge apparatus according to claim 5, wherein said control means controls said inclining means to make a downstream edge in a transport direction of the sheet discharged by said discharge means higher than a highest level of said support means until a determined number of sheets are discharged by said discharge means.

8. A sheet discharge apparatus according to claim 6, wherein said control means controls said inclining means to make a downstream edge in a transport direction of the sheet discharged by said discharge means higher than a highest level of said support means until a determined number of sheets are discharged by said discharge means.

9. A sheet discharge apparatus comprising:

discharge means for discharging a sheet received from an image forming apparatus;

support means disposed downstream of said discharge means in a direction of sheet discharge;

storage means disposed downstream of said support means in the direction of sheet discharge;

moving means for moving said sheet in a state straddling said support means and said storage means discharged by said discharge means to said storage means;

elevator means for raising and lowering said storage means relative to the supporting means;

sheet size determination means for determining a sheet size of the sheet discharged from the discharge means; and control means for controlling said elevator means so that a position of said storage means differs with regard to said support means when the sheet is discharged by said discharge means, and when the sheet is moved by said moving means, and to vary the position of said storage means with regard to said support means when the sheet discharged by said discharge means is determined to be greater than a predetermined size by the sheet size determination means.

10. A sheet discharge apparatus according to claim 9, wherein said control means controls said elevator means so that a relative position of said storage means is lower with regard to said support means when moving a sheet by said moving means than discharging a sheet by said discharge means.

11. A sheet discharge apparatus according to claim 9, wherein said control means controls said elevator means to make a downstream edge in a transport direction of the sheet discharged by said discharge means higher than a highest level of said support means when a the sheet is discharged by said discharge means.

12. A sheet discharge apparatus according to claim 10, wherein said control means controls said elevator means to make a downstream edge in a transport direction of the sheet discharged by said discharge means higher than a highest level of said support means when the sheet is discharged by said discharge means.

13. A sheet discharge apparatus comprising:

discharge means for discharging a sheet received from an image forming apparatus;

support means disposed downstream of said discharge means in a direction of sheet discharge;

storage means disposed downstream of said support means in the direction of sheet discharge;

moving means for moving said sheet in a state straddling said support means and said storage means discharged by said discharge means to said storage means;

inclining means for varying an angle of incline between said support means and said storage means; and control means for controlling said inclining means so that the angle of incline of said storage means differs with regard to said support means when the sheet is discharged by said discharge means and when the sheet is moved by said moving means.

14. A sheet discharge apparatus according claim 13, wherein said control means controls said inclining means so that said angle of incline of said storage means is smaller with regard to said support means when the sheet is discharged by said discharge means and when the sheet is moved said moving means.

15. A sheet discharge apparatus according to claim 13, wherein said control means controls said inclining means to make a downstream edge in the transport direction of the sheet discharged by said discharge means higher than a highest level of said support means when the sheet is discharged by said discharge means.

16. A sheet discharge apparatus according to claim 14, wherein said control means controls said inclining means to make a downstream edge in the transport direction of the sheet discharged by said discharge means higher than a highest level of said support means when the sheet is discharged by said discharge means.

17. A sheet discharge apparatus according to claim 1, wherein said discharge means is further equipped with finishing means that finishes the sheet in the state straddling said support means and s aid storage means discharged by said discharge means.

18. A sheet discharge apparatus according to claim 5, wherein said discharge means is further equipped with finishing means that finishes the sheet in the state straddling said support means and said storage means discharged by said discharge means.

19. A sheet discharge apparatus according to claim 9, wherein said discharge means is further equipped with finishing means that finishes the sheet in the state straddling said support means and said storage means discharged by said discharge means.

20. A sheet discharge apparatus according to claim 13, wherein said discharge means is further equipped with finishing means that finishes the sheet in the state straddling said support means and said storage means discharged by said discharge means.

* * * * *